US007159580B2

(12) United States Patent
Shikama et al.

(10) Patent No.: US 7,159,580 B2
(45) Date of Patent: Jan. 9, 2007

(54) FAILURE DIAGNOSIS APPARATUS FOR EVAPORATIVE FUEL PROCESSING SYSTEM

(75) Inventors: Mahito Shikama, Wako (JP); Daisuke Sato, Wako (JP); Takeshi Hara, Wako (JP); Takashi Yamaguchi, Wako (JP); Koichi Yoshiki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/204,970

(22) Filed: Aug. 17, 2005

(65) Prior Publication Data

US 2006/0052931 A1 Mar. 9, 2006

(30) Foreign Application Priority Data

Sep. 7, 2004 (JP) ..... 2004-259800

(51) Int. Cl.
*F02M 37/04* (2006.01)
*F02M 33/02* (2006.01)

(52) U.S. Cl. ..... 123/520; 123/518

(58) Field of Classification Search ..... 123/516, 123/517, 518, 519, 520, 198 D, 698, 699
See application file for complete search history.

(56) References Cited

U.S. PATENT DOCUMENTS 6,336,446 B1 * 1/2002 Isobe et al. ..... 123/520
6,467,463 B1 * 10/2002 Kitamura et al. ..... 123/516
6,789,523 B1 * 9/2004 Oki et al. ..... 123/198 D
6,950,742 B1 * 9/2005 Yamaguchi et al. ..... 701/114
7,040,302 B1 * 5/2006 Yamaguchi et al. ..... 123/520

FOREIGN PATENT DOCUMENTS

JP 2002-357164 12/2002

* cited by examiner

*Primary Examiner*—John T. Kwon
(74) *Attorney, Agent, or Firm*—Arent Fox PLLC

(57) ABSTRACT

A failure diagnosis apparatus for diagnosing a failure of an evaporative fuel processing system wherein a pressure in the evaporative fuel processing system is detected, and a purge control valve and a vent shut valve are closed when stoppage of the engine is detected. A determination is made as to whether there is a leak in the evaporative fuel processing system based on the detected pressure during a predetermined determination period after closing of the purge control and vent shut valves. The determination result is decided according to a parameter indicative of an amount of evaporative fuel generated in the fuel tank after stoppage of the engine.

15 Claims, 18 Drawing Sheets

FAILURE DIAGNOSIS APPARATUS FOR EVAPORATIVE FUEL PROCESSING SYSTEM

BACKGROUND OF THE INVENTION

1. Field of the Invention

The present invention relates to a failure diagnosis apparatus for diagnosing failure of an evaporative fuel processing system which temporarily stores evaporative fuel generated in a fuel tank and supplies the stored evaporative fuel to an internal combustion engine.

2. Description of the Related Art

A failure diagnosis apparatus which determines whether there is a leak in an evaporative fuel processing system after stoppage of the internal combustion engine is disclosed, for example, in Japanese Patent Laid-open No. 2002-357164. According to the conventional failure diagnosis apparatus, air is pressurized by a motor pump and introduced into the evaporative fuel processing system, and a determination is made based on a value of the load current of the motor pump as to whether there is a leak in the evaporative fuel processing system. Specifically, when a leak is determined to be present in the evaporative fuel processing system, the load current value of the motor pump decreases. Therefore, when the load current value during pressurization is lower than a predetermined determination threshold value, a determination is made that there is a leak in the evaporative fuel processing system.

In the conventional failure diagnosis apparatus described above, use of a motor pump is necessary to perform the pressurization, which complicates configuration of the apparatus and increases the cost of the apparatus. Further, if there is a leak, another problem with the conventional failure diagnosis apparatus is that the evaporative fuel in the evaporative fuel processing system is emitted to the atmosphere by the pressurized air.

SUMMARY OF THE INVENTION

It is an aspect of the present invention to provide a failure diagnosis apparatus having a relatively simple configuration and which rapidly determines the presence of a leak in the evaporative fuel processing system during stoppage of the internal combustion engine.

To attain the above aspect, the present invention provides a failure diagnosis apparatus for diagnosing a failure of an evaporative fuel processing system which includes a fuel tank and a canister having adsorbent for adsorbing evaporative fuel generated in the fuel tank. An air passage is connected to the canister for communicating the canister with the atmosphere. A first passage is provided for connecting the canister and the fuel tank, while a second passage is provided for connecting the canister and an intake system of an internal combustion engine. A vent shut valve opens and closes the air passage, and a purge control valve is provided in the second passage. The failure diagnosis apparatus is characterized by including pressure detecting means, engine stoppage detecting means, first determining means, second determining means, evaporative fuel parameter calculating means, and final determining means. The pressure detecting means detects a pressure in the evaporative fuel processing system. The engine stoppage detecting means detects stoppage of the engine. The first determining means closes the purge control valve and the vent shut valve when stoppage of the engine is detected by the engine stoppage detecting means, and determines whether there is a leak in the evaporative fuel processing system based on a determination parameter (EDDPLSQA) corresponding to a second-order derivative value of the pressure (PTANK, PEONVAVE) detected by the pressure detecting means during a first predetermined determination period (TMDDPTL) after closing of the purge control valve and the vent shut valve. The second determining means determines whether the leak is present in the evaporative fuel processing system based on a relationship between the pressure (PTANK, CDTMPCHG) detected by the pressure detecting means and a staying time period (TDTMSTY, CTMDTY) in which the detected pressure stays at a substantially constant value, during a second predetermined determination period (TMEOMAX) which is longer than the first predetermined determination period (TMDDPTL) after closing of the purge control valve and the vent shut valve. The evaporative fuel parameter calculating means calculates an evaporative fuel parameter (DPEOMAX) indicative of an amount of evaporative fuel generated in the fuel tank after stoppage of the engine. The final determining means selects one of the determination results of the first determining means and the second determining means, according to the evaporative fuel parameter (DPEOMAX) calculated by the evaporative fuel parameter calculating means.

With the above-described configuration, one of a determination result of the first determining means which performs a determination based on a determination parameter corresponding to a second-order derivative value of the detected pressure and a determination result of the second determining means which performs a determination based on the staying time period of the detected pressure, is selected according to the evaporative fuel parameter. The determination by the first determining means is suitable for a condition where a lot of evaporative fuel is generated, while the determination by the second determining means is suitable for a condition where an amount of generated evaporative fuel is little. Therefore, by selecting one of the determination results of the first and second determining means according to the evaporative fuel parameter, accurate determination is performed using a failure diagnosis apparatus having a simple configuration.

Preferably, the final determining means selects the determination result of the first determining means, when the evaporative fuel parameter (DPEOMAX) is greater than or equal to a first threshold value (PDDPOKMIN) and the determination by the first determining means is completed.

With the above-described configuration, when the evaporative fuel parameter is greater than or equal to the first threshold value and the determination by the first determining means is completed, the determination result of the first determining means is selected. When the evaporative fuel parameter is greater than or equal to the first threshold value, which indicates that the evaporative fuel generation amount is comparatively great, rapid determination is performed by selecting the determination result of the first determining means.

Preferably, the final determining means selects the determination result of the second determining means, when the evaporative fuel parameter (DPEOMAX) is greater than or equal to a first threshold value (PDDPOKMIN) and the determination by the first determining means is not completed, or when the evaporative fuel parameter is less than the first threshold value (PDDPOKMIN).

With the above-described configuration, when the determination by the first determining means is not completed even if the evaporative fuel parameter is greater than or equal to the first threshold value, or when the evaporative fuel parameter is less than the first threshold value, which indicates that the evaporative fuel generation amount is comparatively small, the determination result of the second determining means is selected. Therefore, even if the determination by the first determining means cannot be done, or the evaporative fuel generation amount is small, the presence of a leak is accurately determined after stoppage of the engine.

Preferably, the final determining means selects the determination result of the first determining means, when the evaporative fuel parameter (DPEOMAX) is greater than or equal to the first threshold value (PDDPOKMIN) and less than a second threshold value (PDDPNGMIN) which is greater than the first threshold value (PDDPOKMIN), and further the detected pressure (PTANK,PDTMBASE) fails to become less than or equal to a predetermined determination pressure (PDTMINI) during the second predetermined determination period (TMEOMAX).

With the above-described configuration, when the evaporative fuel parameter is greater than or equal to the first threshold value and less than a second threshold value which is greater than the first threshold value, and further the detected pressure fails to become less than or equal to a predetermined determination pressure during the second predetermined determination period, the determination result of the first determining means is selected. That is, even when the evaporative fuel parameter is less than the second threshold value, which indicates that the evaporative fuel generation amount is not so great, accurate determination is performed based on the determination result of the first determining means by extending the period for monitoring the detected pressure to the second predetermined determination period.

Preferably, the final determining means selects the determination result of the second determining means, when the evaporative fuel parameter (DPEOMAX) is greater than or equal to the first threshold value (PDDPOKMIN) and less than a second threshold value (PDDPNGMIN) which is greater than the first threshold value (PDDPOKMIN), and further the detected pressure (PTANK,PDTMBASE) becomes less than or equal to a predetermined determination pressure (PDTMINI) during the second predetermined determination period (TMEOMAX).

With the above-described configuration, when the evaporative fuel parameter is greater than or equal to the first threshold value and less than the second threshold value, and further the detected pressure becomes less than or equal to the predetermined determination pressure during the second predetermined determination period, the determination result of the second determining means is selected. Even when the evaporative fuel generation amount is relatively great, accurate determination is performed if the detected pressure sufficiently decreases in an extended period for monitoring the detected pressure. Therefore, accurate determination is performed by selecting the determination result of the second determining means.

Preferably, the first determining means performs the determination based on the determination parameter which is obtained in a process where the detected pressure rises.

Preferably, the first determining means calculates a change rate parameter (DPEONV) indicative of a rate of change in the detected pressure, and performs the determination based on a rate (EDDPLSQA) of change in the change rate parameter (DPEONV). More specifically, the first determining means statistically processes the detected values of the change rate parameter (DPEONV) and detection timings (CEDDPCAL) of the detected values to obtain a regression line indicative of a relationship between the detected value of the change rate parameter (DPEONV) and the detection timing (CEDDPCAL), and performs the determination based on an inclination (EDDPLSQA) of the regression line.

Preferably, the second determining means performs the determination based on a relationship between the detected pressure (PTANK, CDTMPCHG) and the staying time period (TDTMSTY, CTMSTY) when the detected pressure stays at a substantially constant value or decreases. Further, the second determining means statistically processes values of the detected pressure (PTANK,CDTMPCHG) and the staying time period (TDTMSTY,CTMSTY) to obtain a regression line indicative of a relationship between the detected pressure (PTANK,CDTMPCHG) and the staying time period (TDTMSTY,CTMSTY), and performs the determination based on an inclination (EODTMJUD) of the regression line.

Preferably, the second determining means determines that there is a leak in the evaporative fuel processing system when the staying time period (TDTMSTY) exceeds a predetermined determination time period (TDTMLK).

The above-mentioned aspect, other aspects, characteristics, and advantages of the present invention will become apparent from the preferred embodiments which are described in detail below with reference to the attached drawing figures.

DETAILED DESCRIPTION OF THE PREFERRED EMBODIMENTS

Preferred embodiments of the present invention will now be described with reference to the drawings.

Figure 1:
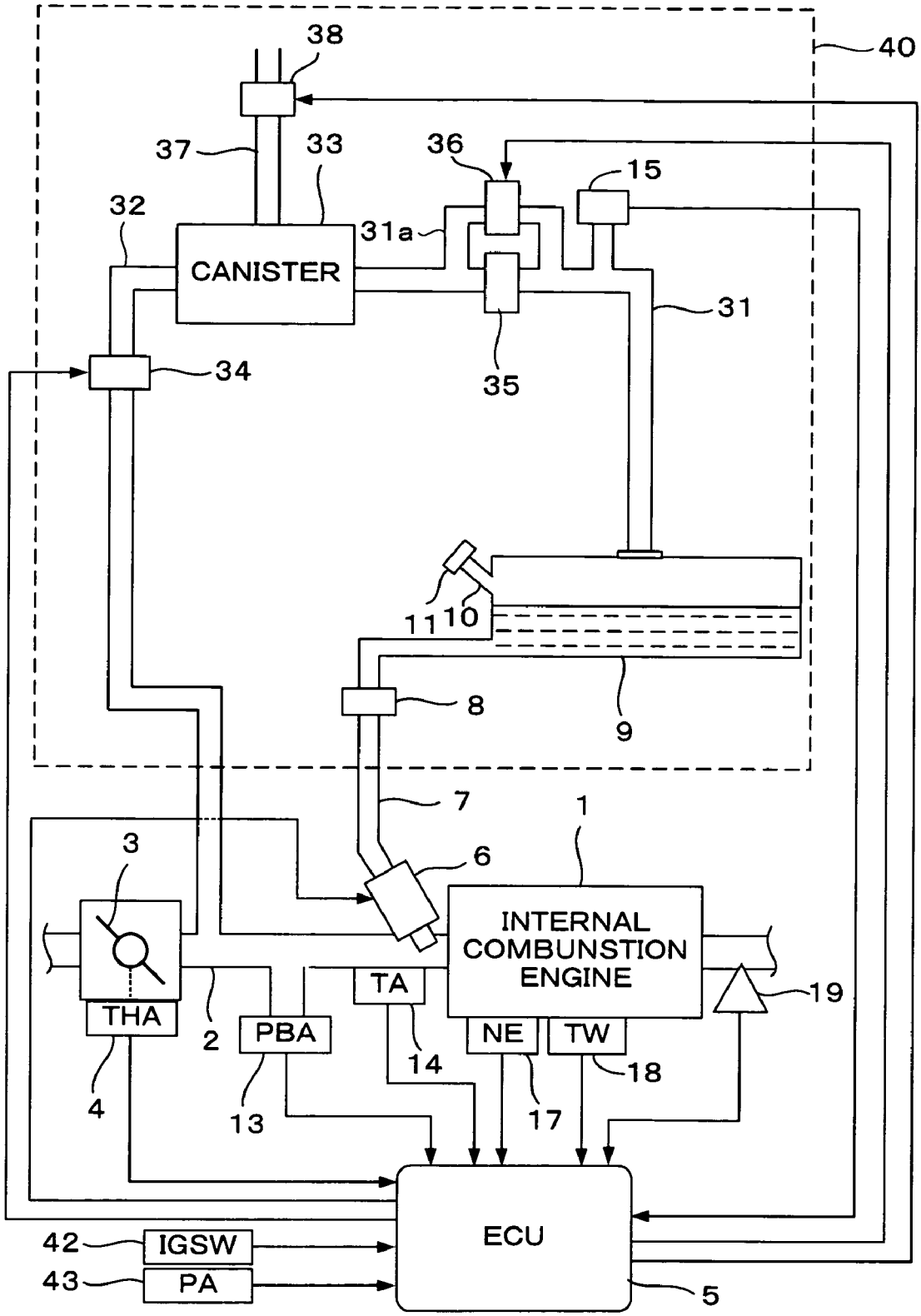
FIG. 1 is a schematic diagram of an evaporative fuel processing system and a control system of an internal combustion engine according to a first embodiment of the present invention.

FIG. 1 is a schematic diagram showing a configuration of an evaporative fuel processing system and a control system for an internal combustion engine according to a first embodiment of the present invention. Referring to FIG. 1, reference numeral 1 denotes an internal combustion engine (hereinafter referred to as "engine") having a plurality of (e.g., four) cylinders. The engine 1 is provided with an intake pipe 2 in which a throttle valve 3 is mounted. A throttle valve opening (THA) sensor 4 is connected to the throttle valve 3. The throttle valve opening sensor 4 outputs an electrical signal corresponding to an opening of the throttle valve 3 and supplies the electrical signal to an electronic control unit (hereinafter referred to as "ECU") 5.

A portion of the intake pipe 2, between the engine 1 and the throttle valve 3, is provided with a plurality of fuel injection valves 6 respectively corresponding to the plural cylinders of the engine 1 at positions slightly upstream of the respective intake valves (not shown). Each fuel injection valve 6 is connected to a fuel tank 9 by a fuel supply pipe 7 that is provided with a fuel pump 8. The fuel tank 9 has a fuel filler neck 10 used during refueling. A filler cap 11 is mounted on the fuel filler neck 10.

Each fuel injection valve 6 is electrically connected to the ECU 5 and has a valve opening period controlled by a signal from the ECU 5. The intake pipe 2 is provided with an absolute intake pressure (PBA) sensor 13 and an intake air temperature (TA) sensor 14 at positions downstream of the throttle valve 3. The absolute intake pressure sensor 13 detects an absolute intake pressure PBA in the intake pipe 2. The intake air temperature sensor 14 detects an air temperature TA in the intake pipe 2.

An engine rotational speed (NE) sensor 17 which detects an engine rotational speed is disposed near the outer periphery of a camshaft or a crankshaft (both not shown) of the engine 1. The engine rotational speed sensor 17 outputs a pulse (TDC signal pulse) at a predetermined crank angle per 180-degree rotation of the crankshaft of the engine 1. An engine coolant temperature sensor 18 is provided for detecting a coolant temperature TW of the engine 1 and an oxygen concentration sensor (hereinafter referred to as "LAF sensor") 19 is provided for detecting an oxygen concentration in exhaust gases from the engine 1. Detection signals from the sensors 13 to 15 and 17 to 19 are supplied to the ECU 5. The LAF sensor 19 functions as a wide-region air-fuel ratio sensor, which outputs a signal substantially proportional to an oxygen concentration in the exhaust gases, i.e., proportional to an air-fuel ratio of an air-fuel mixture supplied to the engine 1.

An ignition switch 42 and an atmospheric pressure sensor 43 for detecting the atmospheric pressure are also connected to the ECU 5. A switching signal from the ignition switch 42 and a detection signal from the atmospheric pressure sensor 43 are supplied to the ECU 5.

The fuel tank 9 is connected, through a charging passage 31, to a canister 33. The canister 33 is connected, through a purging passage 32, to the intake pipe 2 at a position downstream of the throttle valve 3.

The charging passage 31 is provided with a two-way valve 35. The two-way valve 35 includes a positive-pressure valve and a negative-pressure valve. The positive-pressure valve opens when the pressure in the fuel tank 9 is higher than atmospheric pressure by a first predetermined pressure (e.g., 2.7 kPa (20 mmHg)) or more. The negative-pressure valve opens when the pressure in the fuel tank 9 is lower than the pressure in the canister 33 by a second predetermined pressure or more.

The charging passage 31 is branched to form a bypass passage 31*a* that bypasses the two-way valve 35. The bypass passage 31*a* is provided with a bypass valve, i.e., on-off valve, 36. The bypass valve 36 is a solenoid valve that is normally closed, and is opened and closed during execution of a failure diagnosis to hereinafter be described. The operation of the bypass valve 36 is controlled by the ECU 5.

The charging passage 31 is further provided with a pressure sensor 15 disposed between the two-way valve 35 and the fuel tank 9. A detection signal output from the pressure sensor 15 is supplied to the ECU 5. The output PTANK of the pressure sensor 15 takes a value equal to the pressure in the fuel tank 9 in a steady state when the pressures in the canister 33 and the fuel tank 9 are stable. The output PTANK of the pressure sensor 15 takes a value that is different from the actual pressure in the fuel tank 9 when the pressure in the canister 33 or the fuel tank 9 is changing. The output of the pressure sensor 15 will hereinafter be referred to as "tank pressure PTANK".

The canister 33 contains active carbon for adsorbing the evaporative fuel in the fuel tank 9. A vent passage 37 is connected to the canister 33 to facilitate communication of the canister 33 with the atmosphere therethrough.

The vent passage 37 is provided with a vent shut or on-off valve 38. The vent shut valve 38 is a solenoid valve, operation of which is controlled by the ECU 5 in such a manner that the vent shut valve 38 is open during refueling or when the evaporative fuel adsorbed in the canister 33 is purged to the intake pipe 2. Further, the vent shut valve 38 is opened and closed during execution of the failure diagnosis to hereinafter be described. The vent shut valve 38 is a normally open valve which remains open when a drive signal is not supplied thereto.

The purging passage 32, disposed between and connecting the canister 33 and the intake pipe 2, is provided with a purge control valve 34. The purge control valve 34 is a solenoid valve capable of continuously controlling the flow rate by changing the on-off duty ratio of a control signal by changing an opening degree of the purge control valve. The operation of the purge control valve 34 is controlled by the ECU 5.

The fuel tank 9, the charging passage 31, the bypass passage 31*a*, the canister 33, the purging passage 32, the two-way valve 35, the bypass valve 36, the purge control valve 34, the vent passage 37, and the vent shut valve 38 form an evaporative fuel processing system 40.

In this embodiment, even after the ignition switch 42 is turned off, the ECU 5, the bypass valve 36, and the vent shut valve 38 are kept powered during the execution period of the failure diagnosis to hereinafter be described. The purge control valve 34 is powered off to maintain a closed condition when the ignition switch 42 is turned off.

When a large amount of evaporative fuel is generated upon refueling of the fuel tank 9, the canister 33 stores the evaporative fuel. In a predetermined operating condition of the engine 1, the duty control of the purge control valve 34 is performed to supply a suitable amount of evaporative fuel from the canister 33 to the intake pipe 2.

The ECU 5 includes an input circuit, a central processing unit (hereinafter referred to as "CPU"), a memory circuit, and an output circuit. The input circuit has various functions, including shaping the waveform of input signals from various sensors, correcting a voltage level to a predetermined level, and converting analog signal values into digital signal values. The memory circuit stores operation programs to be executed by the CPU, results of the calculations performed by the CPU, and the like. The output circuit supplies driving signals to the fuel injection valve 6, purge control valve 34, bypass valve 36, and vent shut valve 38.

The CPU in the ECU 5 performs control of a fuel amount to be supplied to the engine 1, duty control of the purge control valve, and other necessary controls according to output signals of the various sensors, such as the engine rotational speed sensor 17, the absolute intake pressure sensor 13, and the engine water temperature sensor 18. The CPU in the ECU 5 executes a failure diagnosis process of the evaporative fuel processing system 40 described below.

In this embodiment, a first determination method and a second determination method, which are described below, are used to determine whether there is a leak in the evaporative fuel processing system 40.

Figure 2A:
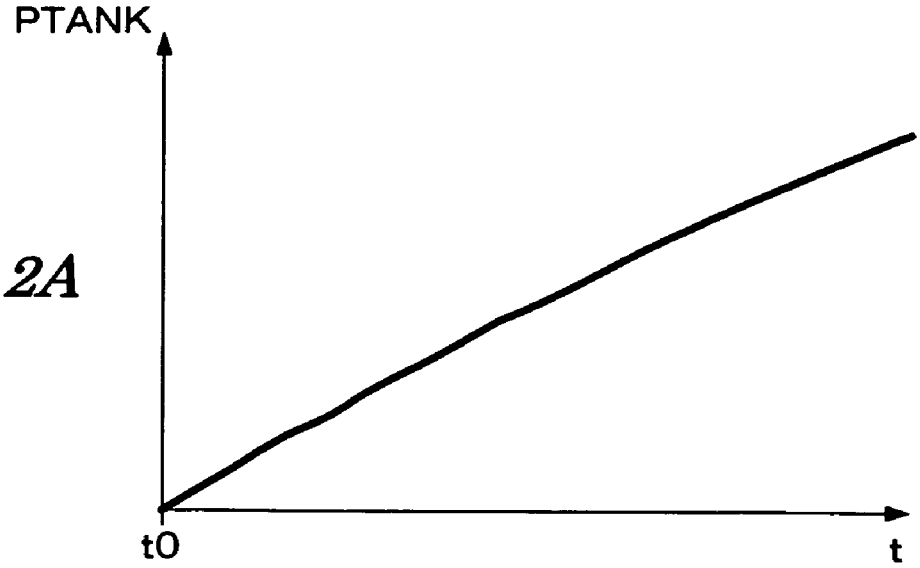
FIGS. 2A and 2B are time charts illustrating changes in the tank pressure (PTANK) when a failure diagnosis of the evaporative fuel processing system is performed.
Figure 2B:
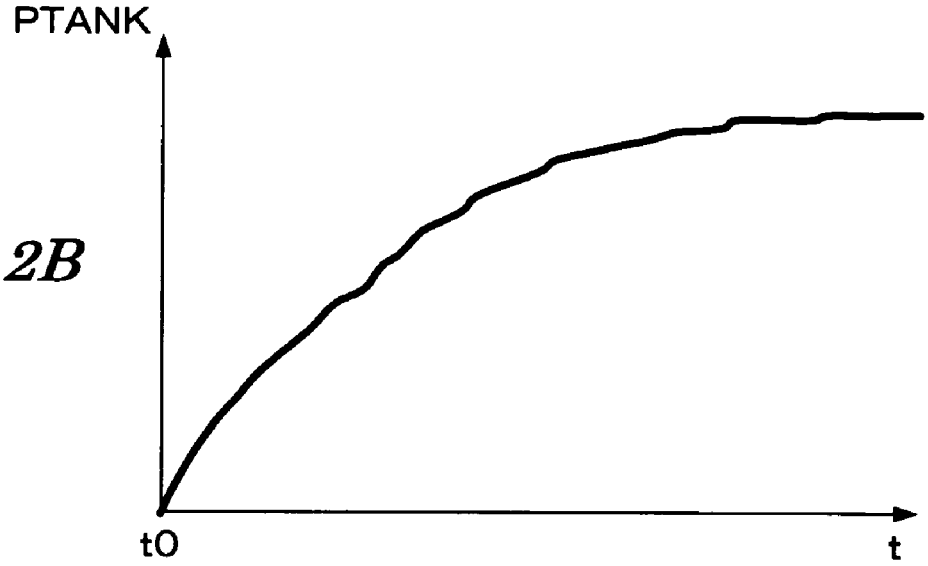

FIGS. 2A and 2B are time charts showing changes in the tank pressure PTANK for illustrating the first determination method. More specifically, FIGS. 2A and 2B illustrate changes in the tank pressure PTANK after time t0 when the vent shut valve 38 is closed. Before closing of the vent shut valve 38, an open-to-atmosphere process for opening the vent shut valve 38 and the bypass valve 36 is executed for a predetermined time period after stoppage of the engine 1. FIGS. 2A and 2B correspond to the case where an amount of evaporative fuel generated in the fuel tank 9 is comparatively great. FIG. 2A corresponds to the case where the evaporative fuel processing system 40 is normal, while FIG. 2B corresponds to the case where there is a leak in the evaporative fuel processing system 40. As can be seen from FIGS. 2A and 2B, when the evaporative fuel processing system 40 is normal, the tank pressure PTANK substantially increases in a linear manner, and when there is a leak in the evaporative fuel processing system 40, the tank pressure PTANK first increases with a comparatively high rate of change (inclination), and thereafter the rate of change in the tank pressure PTANK gradually decreases. Accordingly, by detecting such a difference, a determination is made as to whether there is a leak in the evaporative fuel processing system 40. Specifically, if calculating a determination parameter which corresponds to a second-order derivative value of the tank pressure PTANK, the determination parameter takes a value substantially equal to "0" when the evaporative fuel processing system 40 is normal. The determination parameter will take a negative value when there is a leak in the evaporative fuel processing system 40.

Figure 3A:
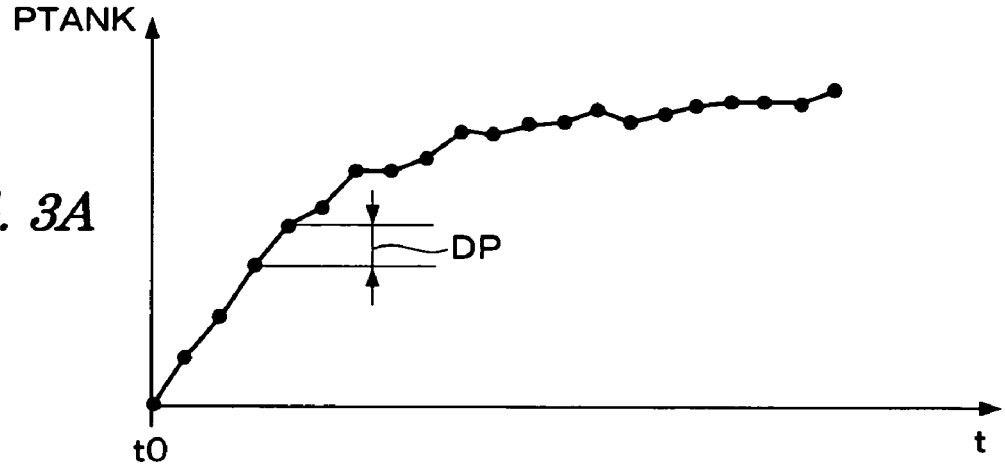
FIG. 3A is a time chart illustrating actually measured data of the tank pressure (PTANK) and FIG. 3B is a diagram showing a regression line (L1) calculated based on the actually measured data.

FIG. 3A illustrates an example of actually measured data of the tank pressure PTANK sampled at constant time intervals. When expressing the detected value of the tank pressure PTANK sampled at constant time intervals as "PTANK(k)", the change amount DP is calculated by the following expression (1).

$$DP=PTANK(k)-PTANK(k-1) \quad (1)$$

Figure 3B:
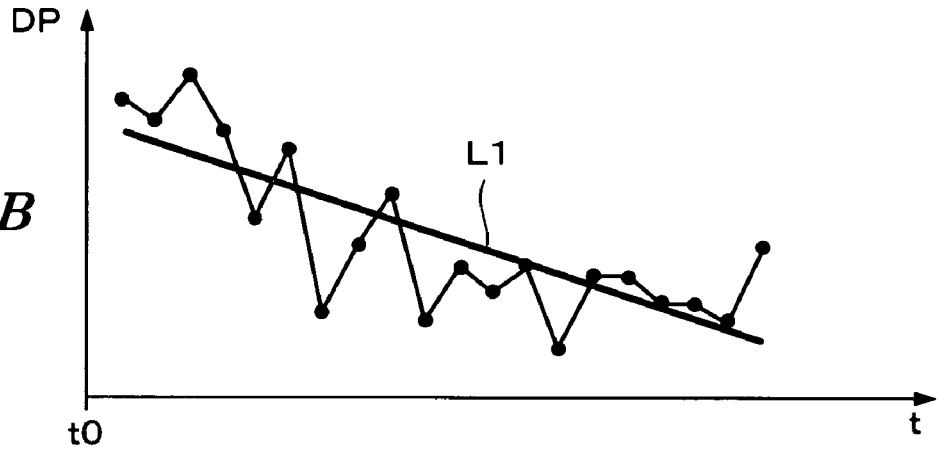

FIG. 3B is a time chart illustrating a transition of the change amount DP. FIG. 3B indicates an overall tendency of the change amount DP to gradually decrease, although the individual data values appear to be dispersed. Therefore, in the present embodiment, a regression line L1 indicating a transition of the change amount DP is determined by the least squares method, and an inclination parameter EDDPLSQA corresponding to an inclination of the regression line L1 is applied to the following expression (2), to calculate a determination parameter EODDPJUD.

$$EODDPJUD=EDDPLSQA/DPEOMAX \quad (2)$$

The inclination parameter EDDPLSQA is a parameter obtained by inversing the sign of the inclination of the regression line L1 shown in FIG. 2B. Therefore, the inclination parameter EDDPLSQA takes a positive value when there is a leak, while the inclination parameter EDDPLSQA takes a value near "0" when the evaporative fuel processing system 40 is normal.

Further, DPEOMAX in the expression (2) is the maximum value of the tank pressure PTANK after time t0, i.e., the time the vent shut valve 38 is closed, which is hereinafter referred to as "maximum pressure DPEOMAX". Since there is a tendency where the maximum pressure DPEOMAX increases as the amount of evaporative fuel generated in the fuel tank increases, the maximum pressure DPEOMAX is used, in this embodiment, as an evaporative fuel parameter indicative of an amount of evaporative fuel that is generated.

Since there is a tendency where the inclination parameter EDDPLSQA increases as the maximum pressure DPEOMAX becomes higher, i.e., as the amount of generated evaporative fuel increases, it is possible to perform accurate determination by using the determination parameter EODDPJUD calculated by the expression (2) even if the amount of generated evaporative-fuel changes.

Figure 4:
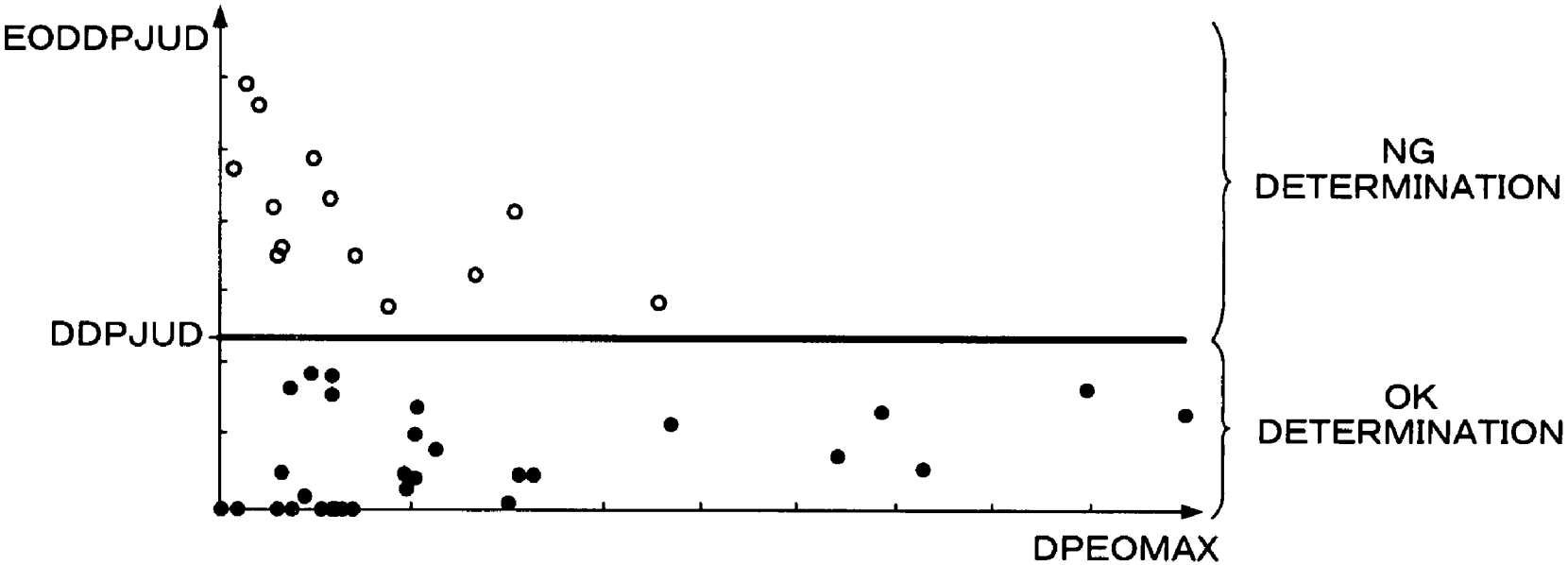
FIG. 4 is a diagram illustrating a first determination method.

FIG. 4 illustrates actually measured data plotted on a coordinate plane defined by the horizontal axis, which indicates the maximum pressure DPEOMAX, and the vertical axis, which indicates the determination parameter EODDPJUD. In FIG. 4, black round marks correspond to actually measured data of a normal evaporative fuel processing system and white, or open, round marks correspond to actually measured data of an evaporative fuel processing system in which there is a leak. As seen from FIG. 4, by properly setting a determination threshold value DDPJUD, the case where there is a leak in the evaporative fuel processing system is accurately determined.

According to the first determination method, when there is a comparatively small hole in the evaporative fuel processing system 40 and the change rate of the tank pressure PTANK is very low, the leak through the small hole cannot be detected. Therefore, in the present embodiment, a second determination method is used to determine whether there is a leak through a small hole (hereinafter referred to as "small hole leak") in the evaporative fuel processing system 40.

Figure 5A:
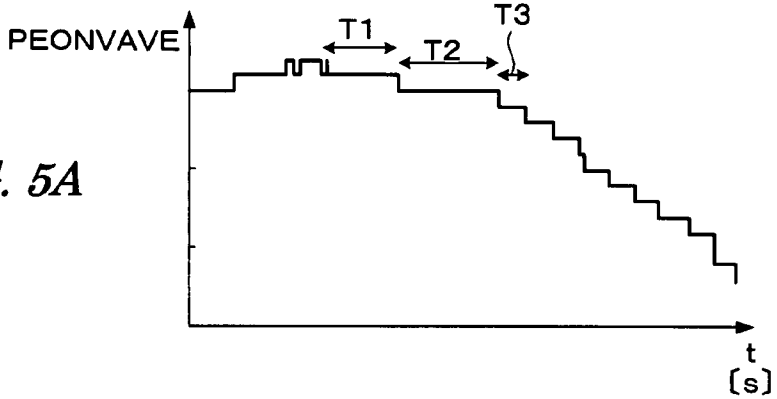
FIGS. 5A to 5D are diagrams illustrating a second determination method according to a second embodiment of the present invention.
Figure 5B:
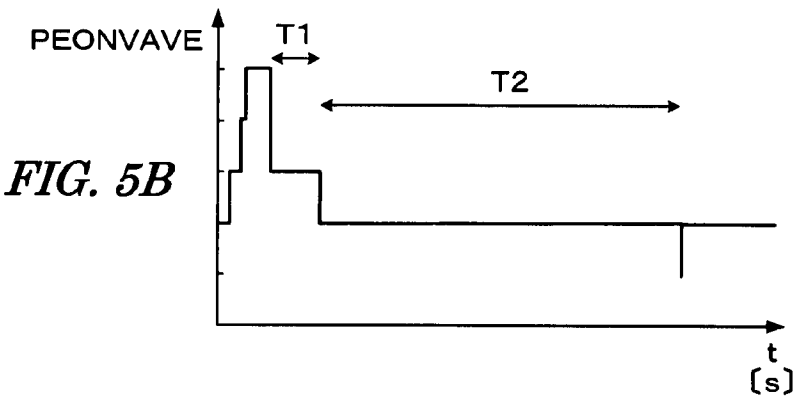
Figure 5C:
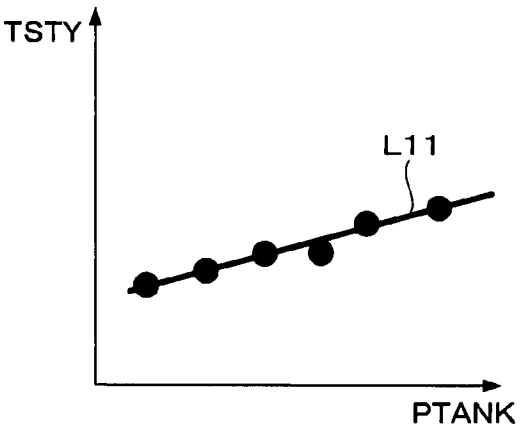
Figure 5D:
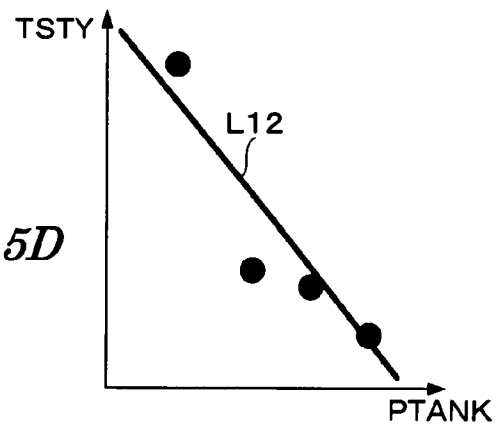

FIGS. 5A to 5D are graphs illustrating the second determination method. FIG. 5A shows changes in the tank pressure PTANK when the evaporative fuel processing system 40 is normal, while FIG. 5B shows changes in the tank pressure PTANK when there is a small hole leak in the evaporative fuel processing system 40. If a time period during which the detected pressure does not vary is defined as a "staying time period TSTY", time periods T1, T2 and T3 correspond to the staying time period TSTY. By plotting the relationship between the staying time period TSTY and the tank pressure PTANK, correlation characteristics shown in FIGS. 5C and 5D are obtained. FIG. 5C corresponds to the case where the evaporative fuel processing system 40 is normal and FIG. 5D corresponds to the case where there is a small hole leak in the evaporative fuel processing system 40. By noting the inclinations of regression lines L11 and L12 shown in FIGS. 5C and 5D, it is apparent that the inclination AL11 of the regression line L11 takes a comparatively small positive value, while the inclination AL12 of the regression line L12 takes a negative value having a large absolute value. Therefore, in the present embodiment, a small hole leak is determined based on the inclination of a regression line indicative of the correlation characteristic between the tank pressure PTANK and the staying time period TSTY. This method is hereinafter referred to as a "second determination method".

It is to be noted that, in the present embodiment, not the tank pressure PTANK itself but a tank pressure parameter PEONVAVE, which is obtained by averaging (low-pass filtering) the tank pressure PTANK, is used for the leak determination.

Figure 6:
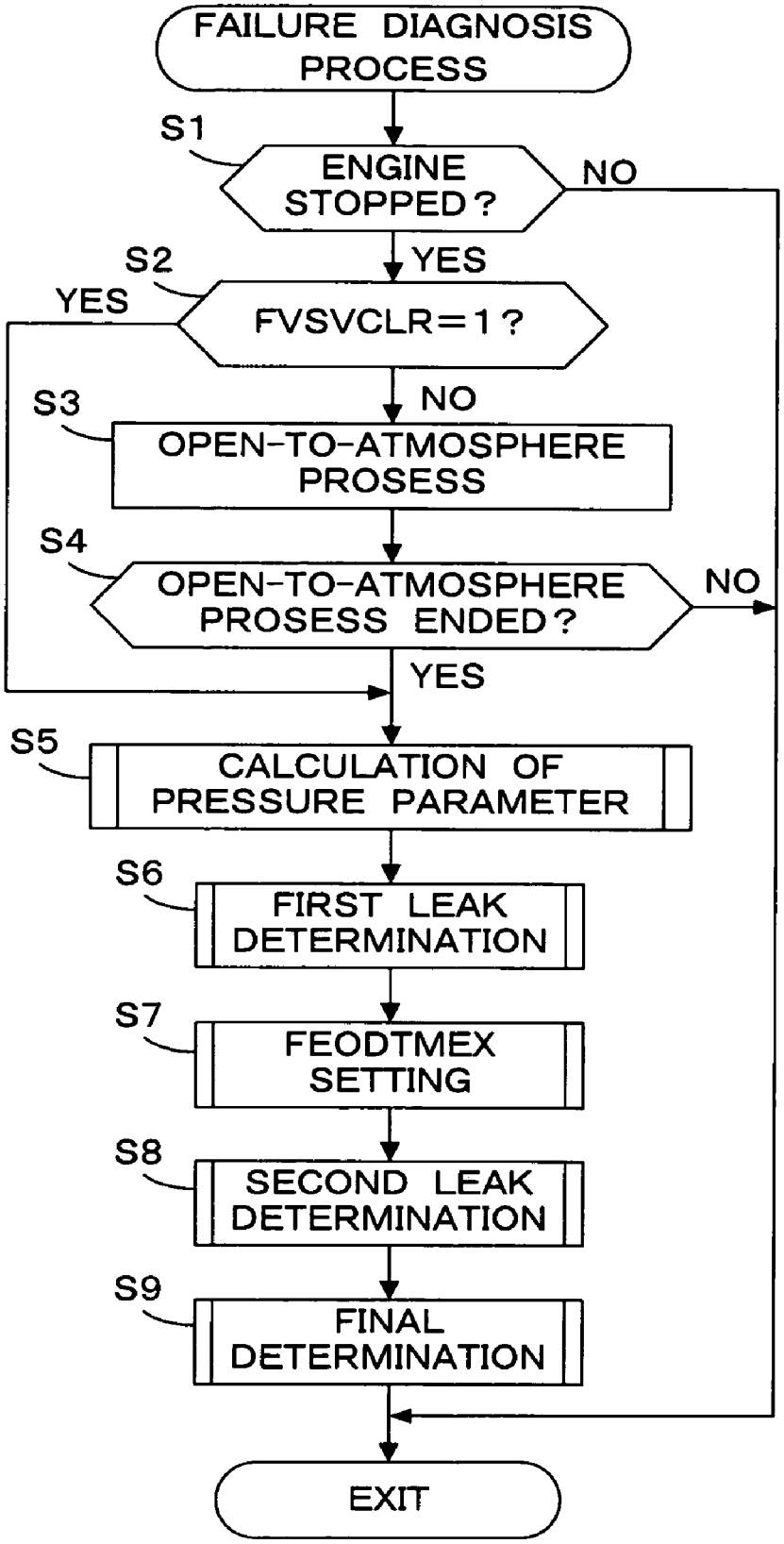
FIG. 6 is a flowchart of a failure diagnosis process of the evaporative fuel processing system.

FIG. 6 is a flowchart of a main part of a failure diagnosis process of the evaporative fuel processing system 40. The above-described failure diagnosis methods are applied to the failure diagnosis process shown in FIG. 6. The failure diagnosis process is executed at predetermined time intervals, e.g., 100 milliseconds, by the CPU in the ECU 5.

In step S1, it is determined whether the engine 1 is stopped, i.e., the ignition switch is turned off. When the engine 1 is operating, the process immediately ends.

When the engine 1 is stopped thereafter, the process proceeds from step S1 to step S2, in which it is determined whether a VSV closing request flag FVSVCLR is "1". The VSV closing request flag FVSVCLR is a flag which is set to "1" when the vent shut valve 38 is to be closed (refer to FIG. 7, step S31). At first, FVSVCLR is equal to "0". Accordingly, the process proceeds to step S3, in which an open-to-atmosphere process is executed. Specifically, the vent shut valve 38 and the bypass valve 36 are opened, which makes the evaporative fuel processing system 40 open to the atmosphere. The open-to-atmosphere process is executed for a predetermined open-to-atmosphere time period, e.g., 90 seconds. In step S4, it is determined whether the open-to-atmosphere process has ended. If the open-to-atmosphere process has not ended, the process immediately ends.

After the open-to-atmosphere process has ended, the process advances from step S4 to step S5, in which a pressure parameter calculation process is executed. Further, a first leak determination process (step S6) shown in FIGS. 8 and 9, an FEODTMEX setting process (step S7) shown in FIGS. 11–13, a second leak determination process (step S8) shown in FIGS. 14 and 15, and a final determination process shown in FIG. 16, are successively executed. If a VSV closing request flag FVSVCLR is set to "1" in the process of FIG. 7, the process immediately proceeds to step S5.

Figure 7:
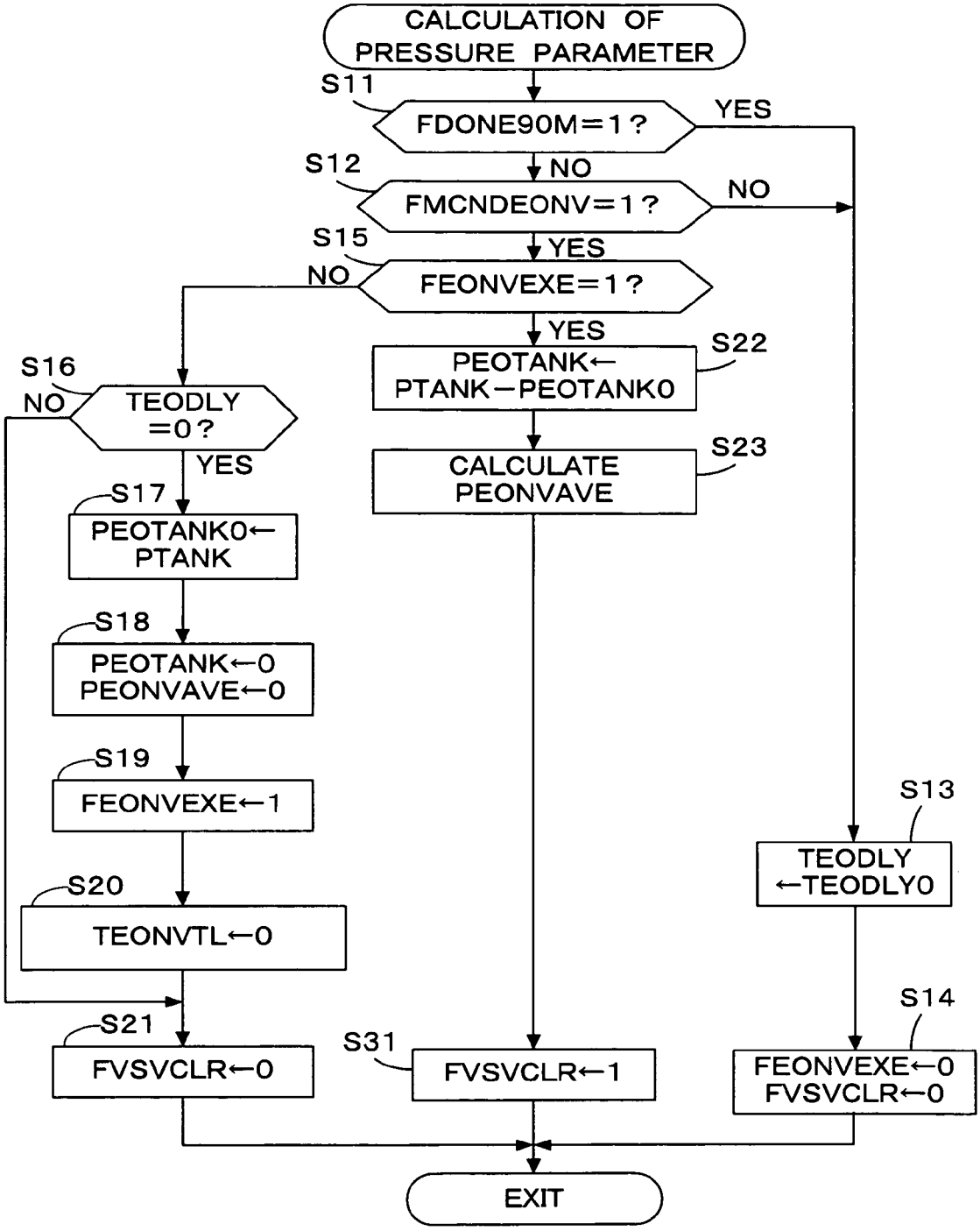
FIG. 7 is a flowchart illustrating a process of calculating a pressure parameter to be used in the leak determination.

FIG. 7 is a flowchart of the pressure parameter calculation process executed in step S5 of FIG. 6. Specifically, in the process of FIG. 7, the tank pressure parameter PEONVAVE is calculated and the vent shut valve 38 is closed.

In step S11, it is determined whether a determination completion flag FDONE90M is "1". If the answer to this step is negative (NO), i.e., if the leak determination is not completed, it is determined whether an execution condition flag FMCNDEONV is "1" (step S12). The execution condition flag FMCNDEONV is set to "1", when the execution condition for the leak determination is satisfied in the execution condition determining process which is not shown. In this embodiment, if the execution condition flag FMCNDEONV is set to "1", the open-to-atmosphere process has ended.

If FMCNDEONV is equal to "1", indicating that the leak determination is terminated, or FMCNDEONV is equal to "0", indicating that the execution condition of the leak determination is not satisfied, the down count timer TEODLY is set to a predetermined time period TEODLY0, e.g., 10 seconds, and started (step S13). In step S14, an execution flag FEONVEXE and the VSV closing request flag FVSVCLR are set to "0" and the process ends. The execution flag FEONVEXE is set to "1" in step S19 described below.

If the execution condition flag FMCNDEONV is "1" in step S12, indicating that the execution condition is satisfied, it is determined whether the execution flag FEONVEXE is "1" (step S15). At first, the answer to step S15 is a negative (NO). Accordingly, the process proceeds to step S16, in which it is determined whether a value of the timer TEODLY started in step S13 is "0." Since the answer to step S16 is a negative (NO) at first, the VSV closing request flag FVSVCLR is set to "0" (step S21). Thereafter, the process ends.

If TEODLY becomes "0" in step S16, the process proceeds to step S17, in which the present tank pressure PTANK is stored as a start pressure PEOTANK0. In step S18, a modified tank pressure PEOTANK and the pressure parameter PEONVAVE are set to "0". The modified tank pressure PEOTANK is calculated by subtracting the start pressure PEOTANK0 from the tank pressure PTANK (refer to step S22). The tank pressure parameter PEONVAVE is calculated by averaging the modified tank pressure PEOTANK (refer to step S23).

In step S19, the execution flag FEONVEXE is set to "1". In step S20, an up count timer TEONVTL is set to "0". Thereafter, the process proceeds to step S21 described above. The up count timer TEONVTL is referred to in steps S98 and S99 of FIG. 11.

After the execution flag FEONVEXE is set to "1" in step S19, the answer to step S15 becomes affirmative (YES). Accordingly, the process proceeds to step S22, in which the modified tank pressure PEOTANK is calculated by subtracting the start pressure PEOTANK0 from the tank pressure PTANK. In step S23, the tank pressure parameter PEONVAVE is calculated by the following expression (3).

$$PEONVAVE = CPTAVE \times PEOTANK + (1 - CPTAVE) \times PEONVAVE \quad (3)$$

where CPTAVE is an averaging coefficient which is set to a value between "0" and "1", and PEONVAVE on the right side is a preceding calculated value of the tank pressure parameter.

In step S31, the VSV closing request flag FVSVCLR is set to "1". Thereafter, the process ends. When the VSV closing request flag FVSVCLR is set to "1", the vent shut valve 38 is closed.

According to the process of FIG. 7, when the execution condition of the leak determination is satisfied, initialization of various parameters is performed (steps S17–S20), and the vent shut valve 38 is then closed (step S31). During execution of the leak determination, calculation of the tank pressure parameter PEONVAVE is executed. The tank pressure parameter PEONVAVE is referred to in the processes (FIGS. 8, 9, and 12) described below.

Figure 8:
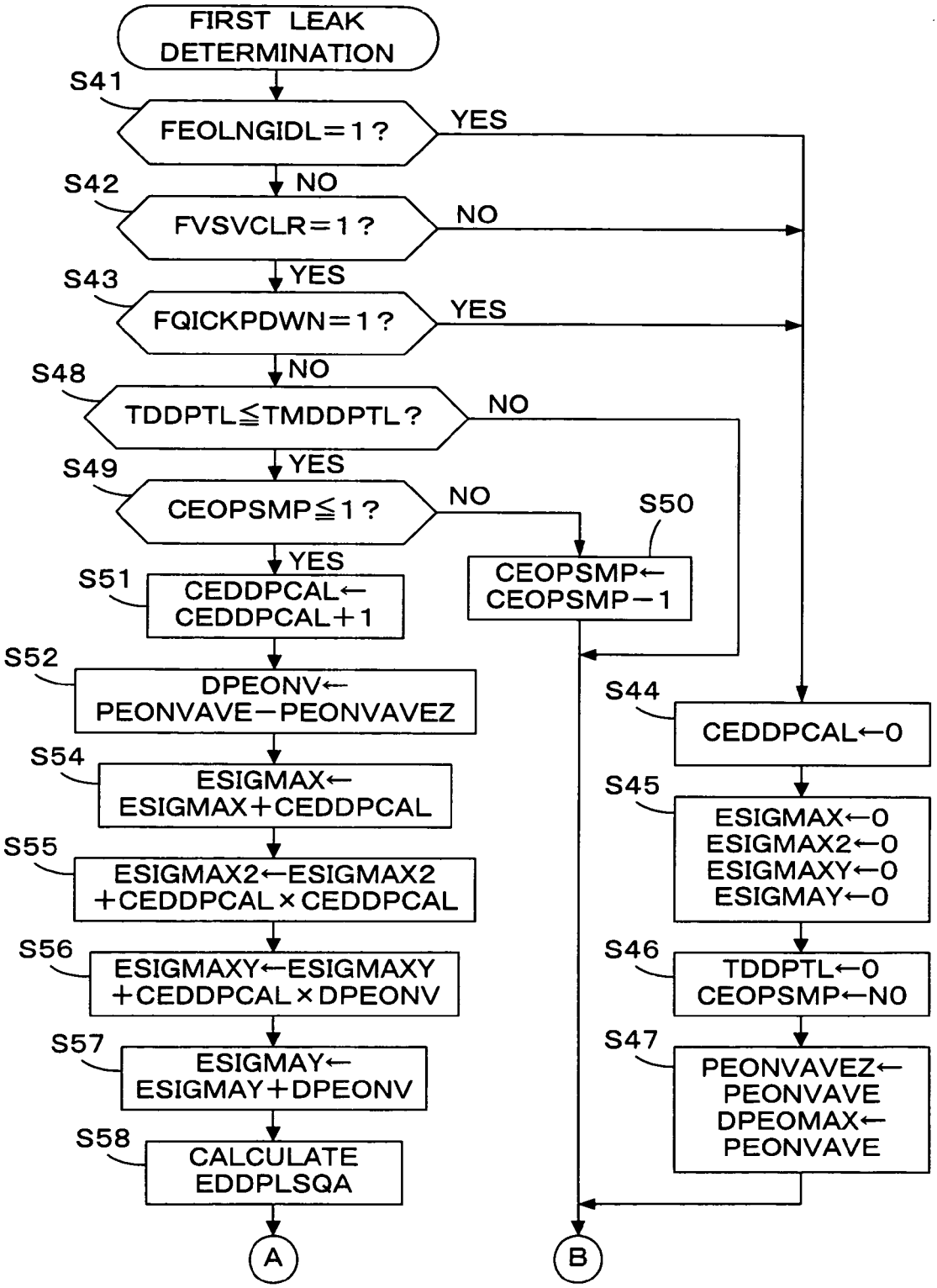
FIGS. 8 and 9 are flowcharts illustrating a process of the leak determination (first leak determination) based on the first determination method.
Figure 9:
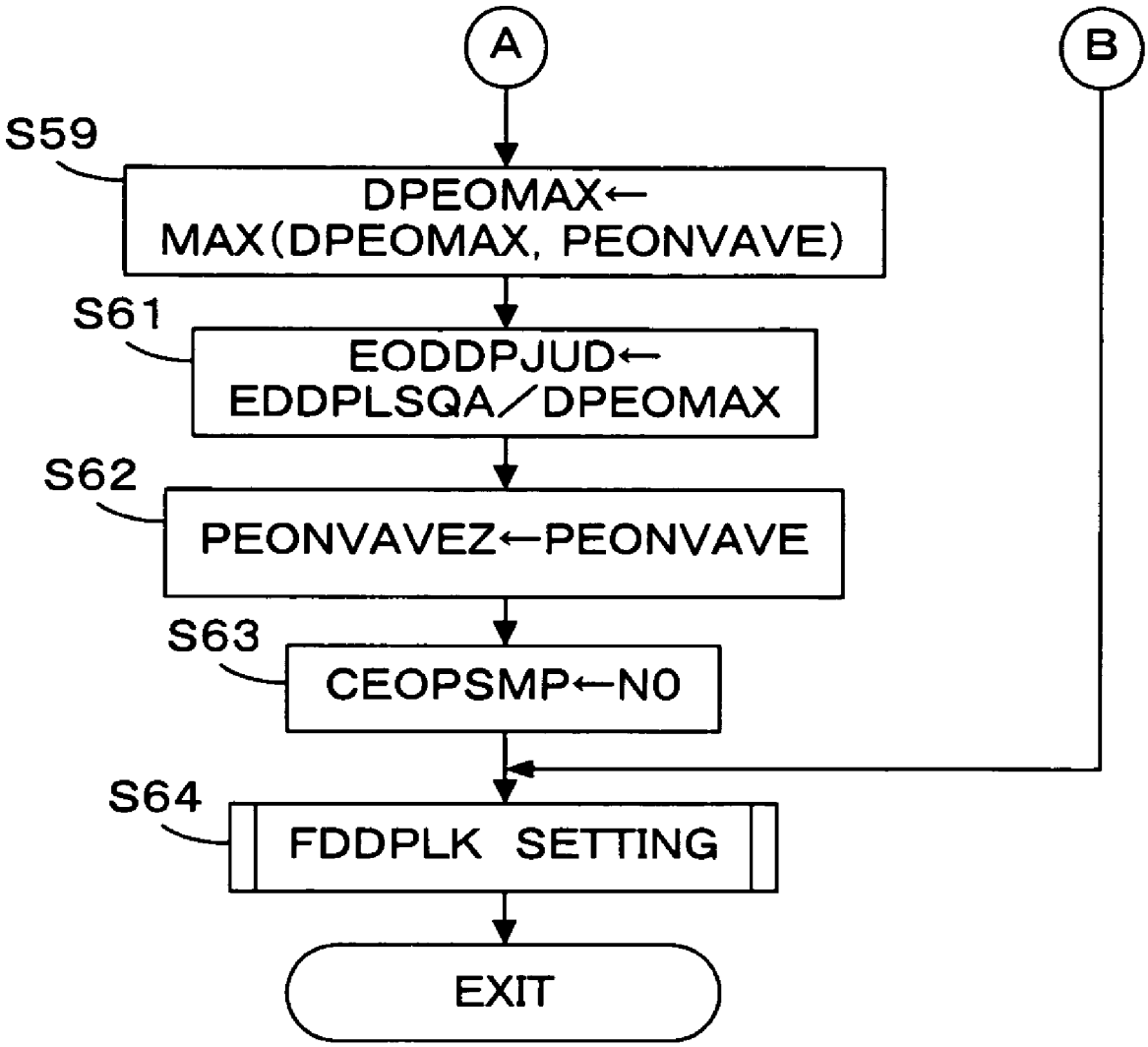

FIGS. 8 and 9 are flowcharts of the first leak determination process executed in step S6 of FIG. 6.

In step S41, it is determined whether a long period idol flag FEOLNGIDL is "1". The long period idle flag FEOLNGIDL is set to "1" in the process (which is not shown) when the idling operation is performed for a long period, which exceeds a predetermined idling period, before stoppage of the engine.

If the long period idle flag FEOLNGIDL is "1", various parameters used in this process are initialized. First in step S44, a time parameter CEDDPCAL, which increases proportionally to the elapsed time, is set to "0". In step S45, the parameters used for calculating the first inclination parameter EDDPLSQA are initialized. Specifically, an integrated value ESIGMAXY of the time parameter CEDDPCAL, an integrated value ESIGMAX2 of a value obtained by squaring the time parameter CEDDPCAL, an integrated value ESIGMAXY of the product of the time parameter CDDPCAL and a pressure change amount DPEONV, and an integrated value of the pressure change amount DPEONV are all set to "0". Further, in step S46, a value of an upcount timer TDDPTL is set to "0", and a counter CEOPSMP is set to a predetermined value NO, e.g., "10". In step S47, a preceding value PEONVAVEZ of the tank pressure parameter and the maximum pressure DPEOMAX are set to the pressure parameter PEONVAVE (present value). After execution of step S47, the process proceeds to step S64.

If FEOLNGIDL is equal to "0" in step S41, it is determined whether the VSV closing request flag FVSVCLR is "1" (step S42). If FVSVCLR is equal to "0", indicating that the vent shut valve 38 is opened, the process proceeds to step S44 described above. If FVSVCLR is equal to "1", indicating that the vent shut valve 38 is closed, it is determined whether a quick down flag FQICKPDWN is "1" (step S43). The quick down flag FQICKPDWN is set to "1" in the FEODTMEX setting process, when the tank pressure PTANK rapidly decreases due to removal of the filler cap 11 when refueling (refer to FIG. 12, step S125).

If the quick down flag FQICKPDWN is "1", indicating that the filler cap 11 is removed, the leak determination cannot be performed. Therefore, the process proceeds to step S44 described above, in which the initialization of the parameters are performed.

When the answer to step S43 is negative (NO), it is determined whether a value of the timer TDDPTL is less than or equal to a predetermined time period TMDDPTL, e.g., 300 seconds, (step S48). Since the answer to step S48 is affirmative (YES) at first, the process proceeds to step S49, in which it is determined whether a value of the counter CEOPSMP is less than or equal to "1". Since the answer to step S49 is negative (NO) at first, the value of the counter CEOPSMP is decremented by "1" (step S50). Thereafter, the process proceeds to step S64.

When the answer to step S49 becomes affirmative (YES), steps S51–S63 are executed to calculate the first inclination parameter EDDPLSQA, the determination parameter EODDPJUD, and the maximum pressure DPEOMAX.

In step S51, the time parameter CEDDPCAL is incremented by "1". In step S52, the pressure change amount DPEONV is calculated by subtracting the preceding value PEONVAVEZ from the present value PEONVAVE of the tank pressure parameter.

In step S54, the integrated value ESIGMAX of the time parameter CEDDPCAL is calculated by the following expression (4).

$$ESIGMAX=ESIGMAX+CEDDPCAL \quad (4)$$

where ESIGMAX on the right side is the preceding calculated value.

In step S55, the integrated value ESIGMAX2 of a value obtained by squaring the time parameter CEDDPCAL is calculated by the following expression (5).

$$ESIGMAX2=ESIGMAX2+CEDDPCAL\times CEDDPCAL \quad (5)$$

where ESIGMAX2 on the right side is the preceding calculated value.

In step S56, the integrated value ESIGMAXY of the product of the time parameter CEDDPCAL and the pressure change amount DPEONV is calculated by the following expression (6).

$$ESIGMAXY=ESIGMAXY+CEDDPCAL\times DPEONV \quad (6)$$

where ESIGMAXY on the right side is the preceding calculated value.

In step S57, the integrated value ESIGMAY of the pressure change amount DPEONV is calculated by the following expression (7).

$$ESIGMAY=ESIGMAY+DPEONV \quad (7)$$

where ESIGMAY on the right side is the preceding calculated value.

In step S58, the time parameter CEDDPCAL and the integrated values ESIGMAX, ESIGMAX2, ESIGMAXY and ESIGMAY, calculated in steps S51 and S54 to S57, are applied to the following expression (8) to calculate the first inclination parameter EDDPLSQA.

$$EDDPLSQA=\frac{ESIGMAXY-(ESIGMAX\times ESIGMAY)/CEDDPCAL}{ESIGMAX2-ESIGMAX^2/CEDDPCAL} \quad (8)$$

In step S59 (FIG. 9), the greater one of the maximum pressure DPEOMAX and the tank pressure parameter PEONVAVE is selected and the maximum pressure DPEOMAX is calculated by the following expression (9).

$$DPEOMAX=MAX(DPEOMAX, PEONVAVE) \quad (9)$$

In step S61, the determination parameter EODDPJUD is calculated by the above expression (2). Next, the preceding value PEONVAVEZ of the tank pressure parameter is set to the present value PEONVAVE (step S62), and the value of the counter CEOPSMP is set to the predetermined value NO (step S63). Thereafter, the process proceeds to step S64.

The answer to step S49 becomes negative (NO) by executing step S63. Accordingly, steps S51 to S63 are executed once in NO times execution of the process. Further, the answer to step S48 becomes negative (NO), if the value of the timer TDDPTL exceeds the predetermined time period TMDDPTL. Then the process immediately proceeds to step S64.

Figure 10:
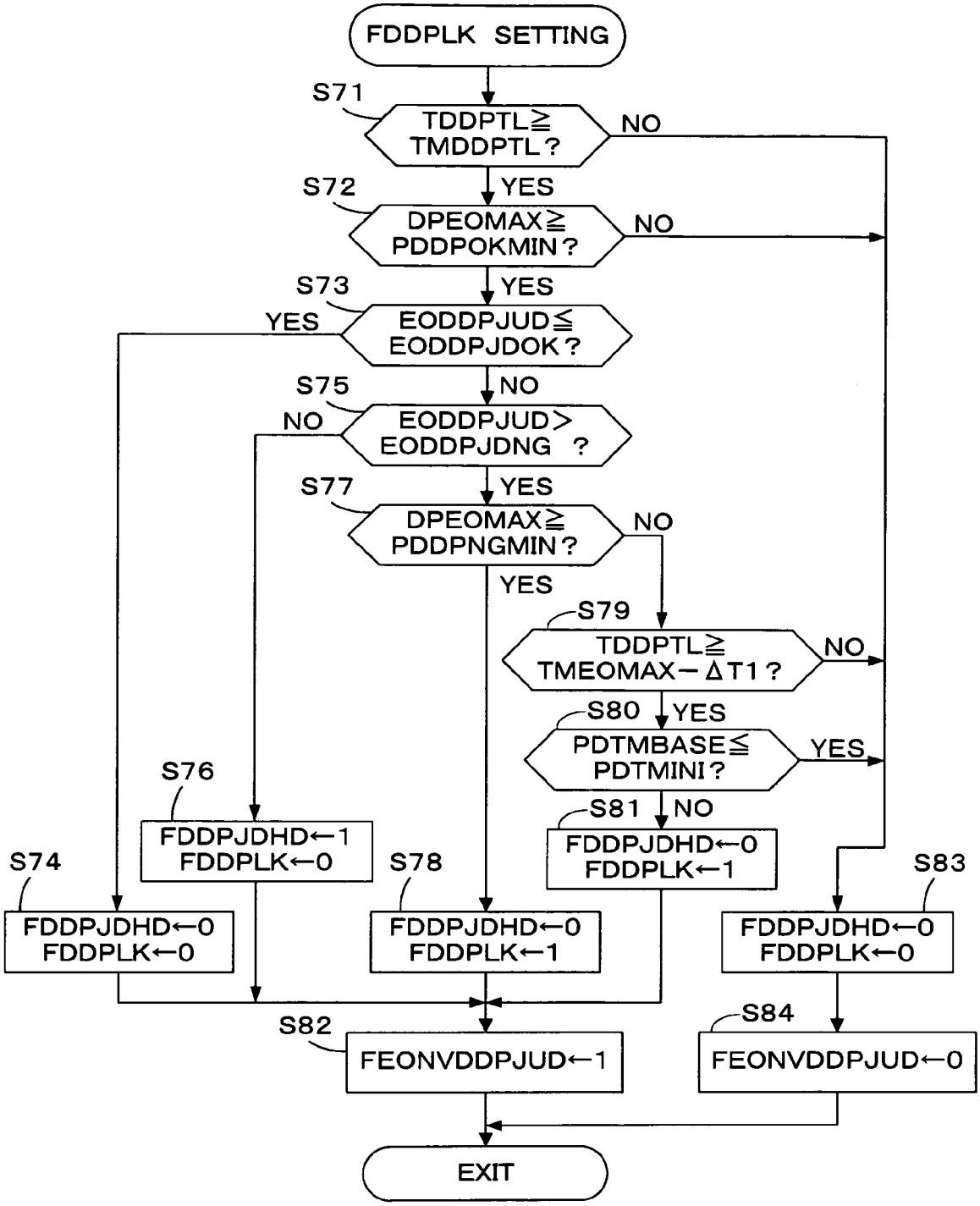
FIG. 10 is a flowchart of a process for setting a first leak determination flag (FDDPLK)

In step S64, the FDDPLK setting process shown in FIG. 10 is executed. Specifically, the determination whether a leak is present is performed based on the determination parameter EODDPJUD, and a first leak determination flag FDDPLK is set to "1", if it is determined that a leak is present in the system.

In step S71 of FIG. 10, it is determined whether the value of the timer TDDPTL is equal to or greater than the predetermined time period TMDDPTL. Since the answer to step S71 is negative (NO) at first, both of a withholding flag FDDPJDHD and the first leak determination flag FDDPLK are set to "0" (step S83), and a first leak determination end flag FEONVDDPJUD is set to "0" (step S84). If the determination parameter EODDPJUD is greater than a predetermined OK determination threshold value EODDPJDOK and is less than or equal to a predetermined NG determination threshold value EODDPJDNG, then the leak determination is withheld, and the withholding flag FDDPJDHD is set to "1" (refer to steps S73, S75, and S76). The first leak determination end flag FEONVDDPJUD is set to "1", when any one of the determination that the system is normal, the determination that a leak is present, or the decision that the leak determination is withheld, is made (step S82 reference).

If the value of the timer TDDPTL reaches the predetermined time period TMDDPTL, the process proceeds from step S71 to step S72, in which it is determined whether the maximum pressure DPEOMAX is equal to or higher than a first threshold value PDDPOKMIN, e.g., 80 Pa (0.6 mmHg). If DPEOMAX is lower than PDDPOKMIN, indicating that the amount of generated evaporative fuel is small, accurate determination cannot be expected by the first determination method. Therefore, the process proceeds to step S83 described above.

If DPEOMAX is equal to or higher than PDDPOKMIN in step S72, it is determined whether the determination parameter EODDPJUD is equal to or less than the predetermined OK determination threshold value EODDPJDOK (step S73). If the answer to step S73 is affirmative (YES), the evaporative fuel processing system 40 is determined to be normal, and both of the withholding flag FDDPJDHD and the first leak determination flag FDDPLK are set to "0" (step S74). Next, the first leak determination end flag FEONVDDPJUD is set to "1" (step S82), and the process ends.

If EODDPJUD is greater than EODDPJDOK in step S73, it is determined whether the determination parameter EODDPJUD is greater than the predetermined NG determination threshold value EODDPJDNG, which is greater than the predetermined OK determination threshold value EODDPJDOK (step S75). If the answer to step S75 is negative (NO), i.e., the determination parameter EODDPJUD is between the predetermined OK determination threshold value EODDPJDOK and the predetermined NG determination threshold values EODDPJDNG, the decision that the leak determination is withheld is made without making the determination that a leak is present or the determination that the system is normal. Accordingly, the withholding flag FDDPJDHD is set to "1" and the first leak determination flag FDDPLK is set to "0" (step S76). Thereafter, the process proceeds to step S82 described above.

If EODDPJUD is greater than EODDPJDNG in step S75, it is determined whether the maximum pressure DPEOMAX is equal to or higher than the second threshold value PDDPNGMIN, e.g., 400 Pa (3 mmHg), which is higher than the first threshold value PDDPOKMIN (step S77). If the answer to step S77 is affirmative (YES), it is determined that a leak is present in the evaporative fuel processing system 40. Accordingly, the withholding flag FDDPJDHD is set to "0" and the first leak determination flag FDDPLK is set to "1" (step S78). Thereafter, the process proceeds to step S82 described above.

If DPEOMAX is lower than PDDPNGMIN in step S77, the determination that a leak is present cannot immediately be made. Therefore, the process proceeds to step S79, in which it is determined whether the value of the timer TDDPTL is equal to or greater than a value obtained by subtracting a predetermined time period $\Delta T1$, e.g., 1 second, from a maximum diagnosing time period TMEOMAX, e.g., 20 minutes. While the answer to step S79 is negative (NO), the process proceeds to step S83 described above. When the answer to step S79 becomes affirmative (YES), it is determined whether a staying pressure parameter PDTMBASE is equal to or lower than the initial pressure PDTMINI (step S80). The staying pressure parameter PDTMBASE is a pressure parameter which very gradually follows up changes in the tank pressure parameter PEONVAVE, and is calculated in the process of FIG. 12 (refer to steps S117 and S126). Further, the initial pressure PDTMINI is set to the value of the pressure parameter PEONVAVE at the time the open-to-atmosphere process has ended, i.e., immediately before the start of the leak determination.

If the answer to step S80 is negative (NO), i.e., the staying pressure parameter PDTMBASE is higher than the initial pressure PDTMINI, it is determined that there is a leak in the evaporative fuel processing system 40. Accordingly, the withholding flag FDDPJDHD is set to "0" and the first leak determination flag FDDPLK set to "1" (step S81). Thereafter the process proceeds to step S82 described above. On the other hand, if the answer to step S80 is affirmative (YES), the process proceeds to step S83 described above, without determining that a leak is present, since there is a possibility that the system is determined to be normal by the second determination method.

Figure 11:
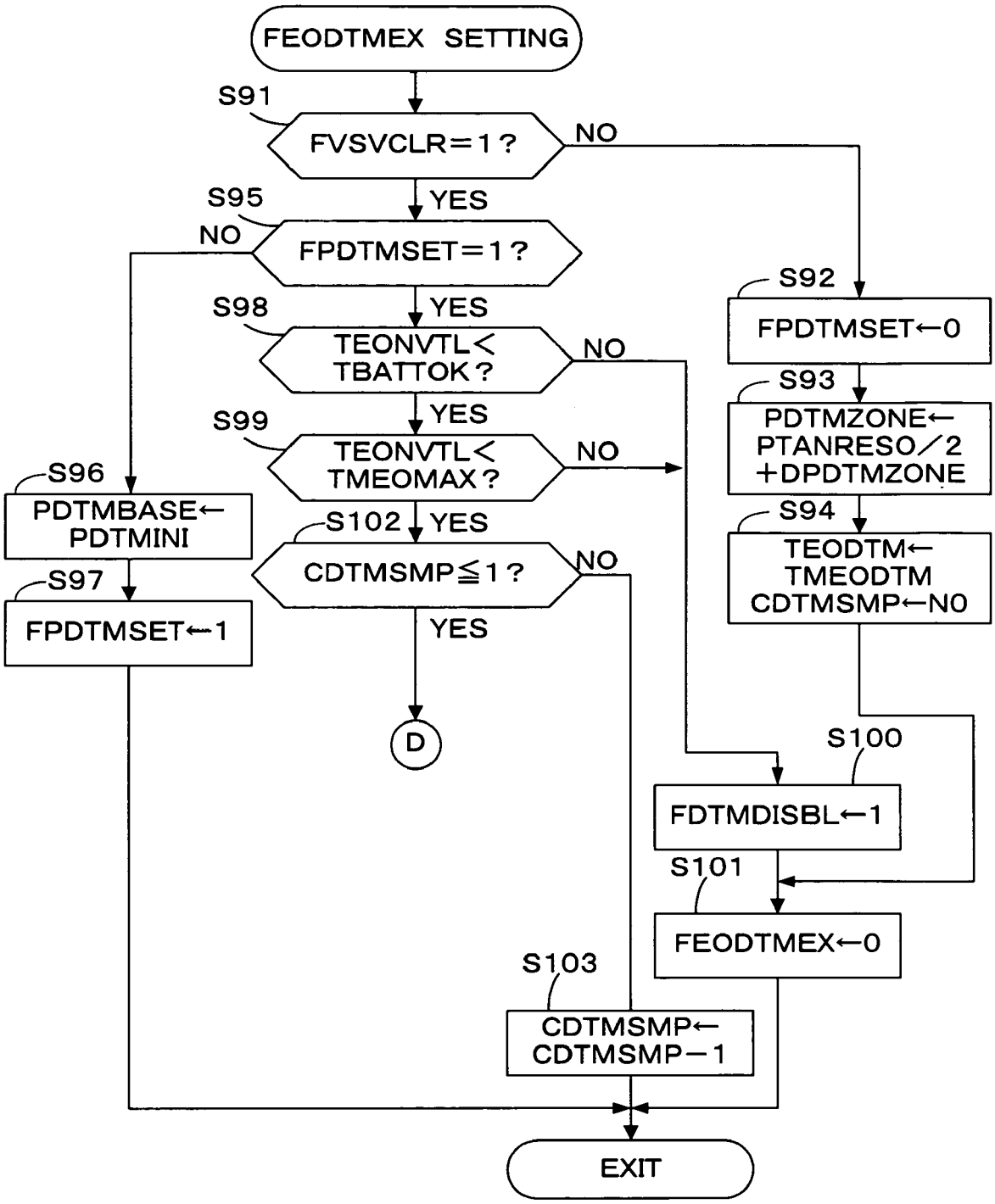
FIGS. 11 to 13 are flowcharts of a process of determining an execution condition of a second leak determination based on the second determination method.
Figure 12:
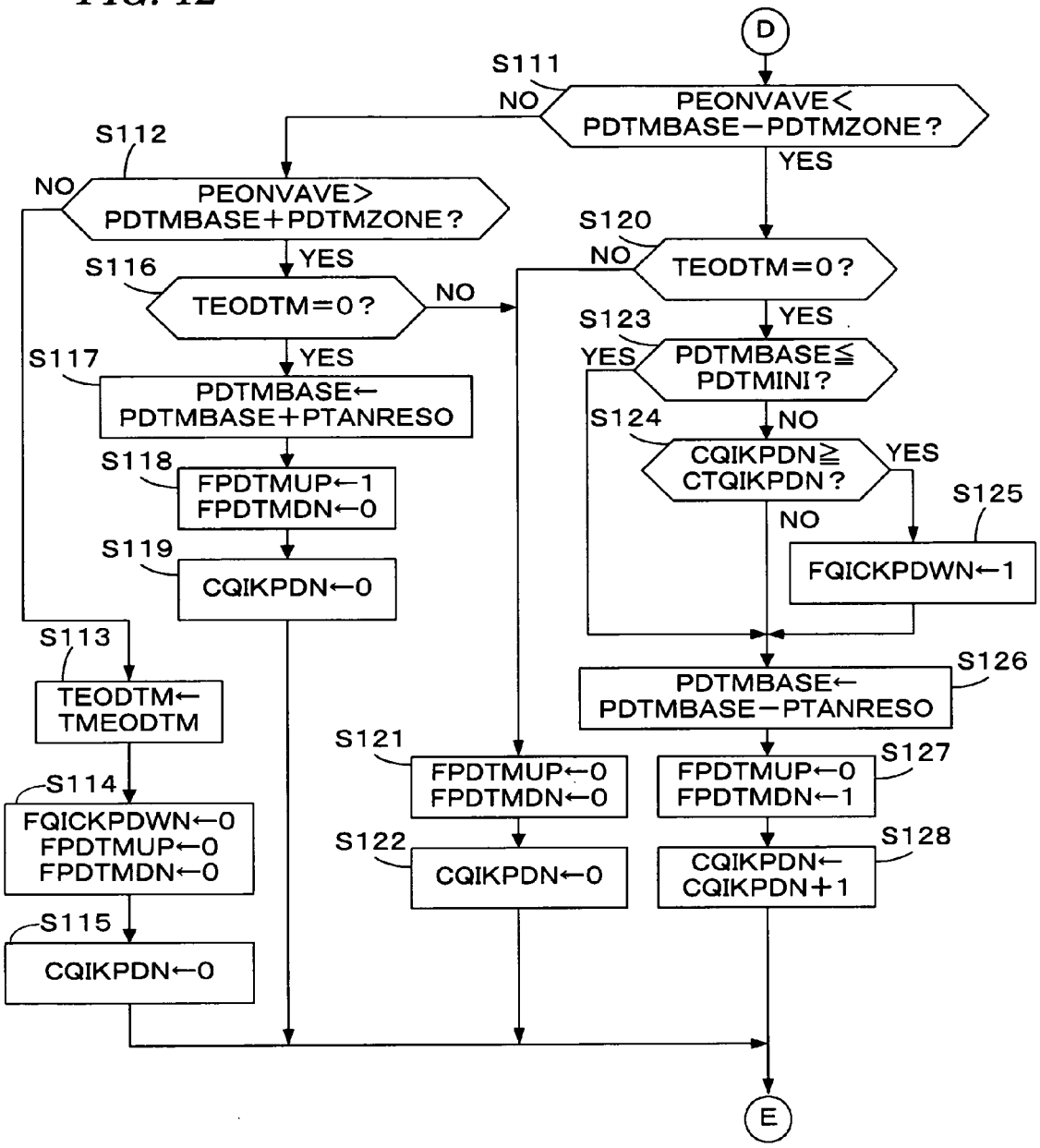
Figure 13:
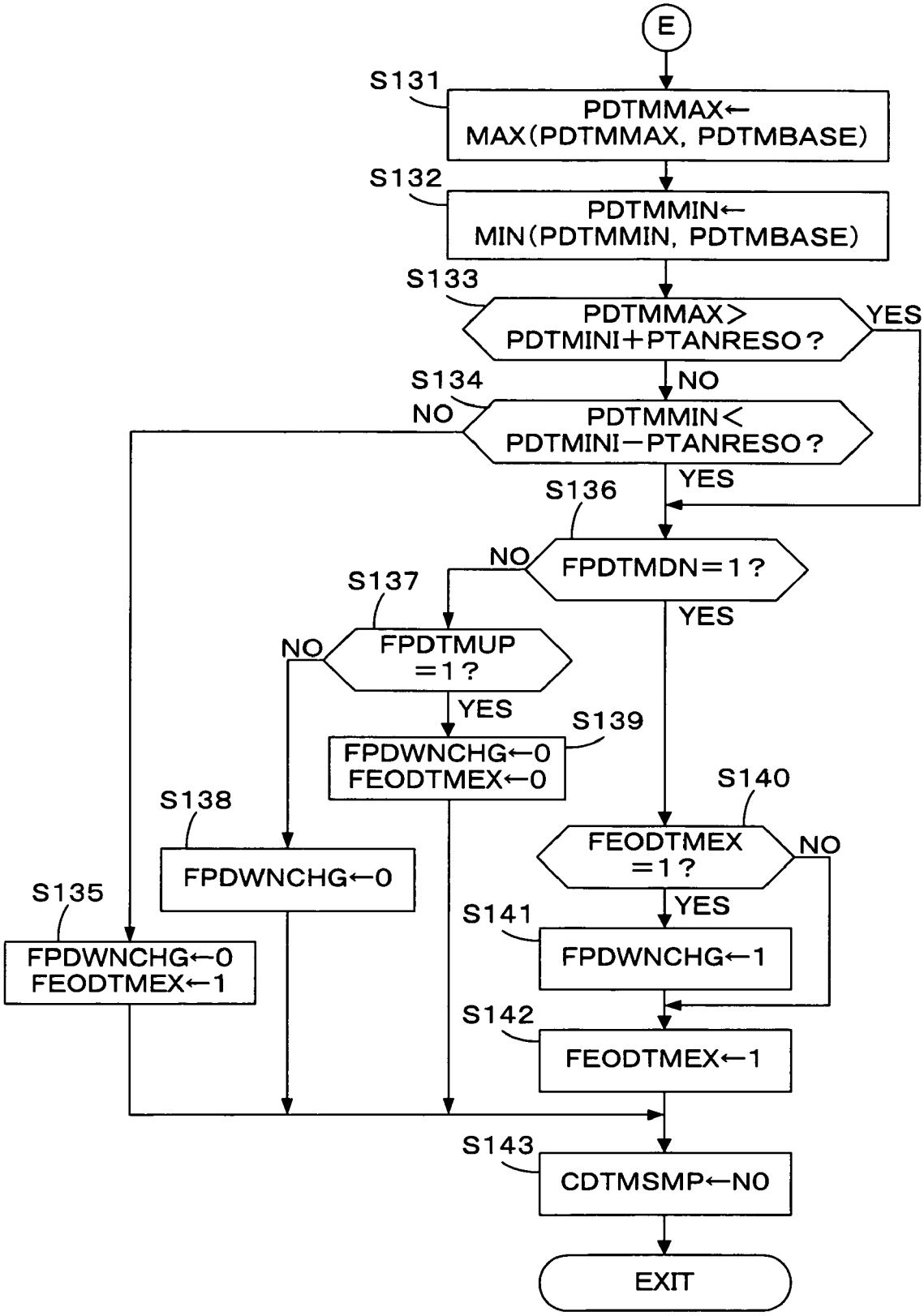

FIGS. 11 to 13 show a flowchart of the FEODTMEX setting process executed in step S7 of FIG. 6. In the process, an execution condition of the second leak determination is determined, and a second leak determination condition flag FEODTMEX set to "1" when the execution condition of the second leak determination is satisfied. Basically, the second leak determination condition flag FEODTMEX is set to "0" when the staying pressure parameter PDTMBASE is increasing, and set to "1" when the staying pressure parameter PDTMBASE is decreasing. Further, when the staying pressure parameter PDTMBASE remains in the vicinity of the atmospheric pressure, the second leak determination condition flag FEODTMEX is set to "1". That is, when the staying pressure parameter PDTMBASE remains in the vicinity of the atmospheric pressure, or the staying pressure parameter PDTMBASE is decreasing, the second leak determination condition flag FEODTMEX is set to "1" and the second leak determination is performed.

In step S91 of FIG. 11, it is determined whether the VSV closing request flag FVSVCLR is "1". If FVSVCLR is equal to "0", indicating that the vent shut valve 38 is opened, an initialization flag FPDTMSET is set to "0" (step S92). The initialization flag FPDTMSET is set to "1", when the initialization of the staying pressure parameter PDTMBASE is completed (refer to step S96).

In step S93, a zone parameter PDTMZONE is calculated by the following expression (10). The zone parameter PDTMZONE is used for monitoring changes in the tank pressure parameter PEONVAVE in steps S111 and S112.

$$PDTMZONE = PTANRESO/2 + DPDTMZONE \quad (10)$$

In the expression (10), PTANRESO is a minimum sensible pressure of the pressure sensor 15. The value of PTANRESO is, for example, 16.3 Pa (0.122 mmHg). DPDTMZONE is a predetermined additional value added for suppressing excessive fluctuations in the staying pressure parameter PDTMBASE, i.e., for giving a hysteresis characteristic to the setting of the staying pressure parameter PDTMBASE. The predetermined additional value DPDTMZONE is calculated in the process of FIG. 12, and is set, for example, to 2.7 Pa (0.02 mmHg).

In step S94, a down count timer TEODTM is set to a predetermined waiting time period TMEODTM, e.g., 1 second, and started, and the predetermined value NO is set to the counter CDTMSMP. In step S101, the second leak determination condition flag FEODTMEX is set to "0".

If the VSV closing request flag FVSVCLR is "1" in step S91, i.e., the vent shut valve 38 closed, it is determined whether the initialization flag FPDTMSET is "1" (step S95). Since FPDTMSET is equal to "0" at first, the staying pressure parameter PDTMBASE is set to the initial pressure PDTMINI (step S96), and the initialization flag FPDTMSET is set to "1" (step S97).

After the initialization flag FPDTMSET is set to "1", the process proceeds from step S95 to step S98, in which it is determined whether the value of an upcount timer TEONVTL is less than a battery permission time period TBATTOK set according to a charging state of the battery. The upcount timer TEONVTL measures an elapsed time period from the time the vent shut valve 38 is closed. If TEONVTL is less than TBATTOK, it is further determined whether the value of the upcount timer TEONVTL is less than the maximum diagnosing time period TMEOMAX (step S99). If the answer to step S98 or S99 is negative (NO), i.e., if the leak determination is not completed in the battery permission time period TBATTOK or the maximum diagnostic time period TMEOMAX, a determination disabling flag FDTMDISBL is set to "1" (step S100), and the process proceeds to step S101 described above. The determination disabling flag FDTMDISBL is referred to in the final determination process shown in FIG. 16 (step S193).

If TEONVTL is less than TMEOMAX in step S99, it is determined whether the value of the counter CDTMSMP initialized in step S94 is equal to or less than "1" (step S102). Since the answer to step S102 is negative (NO) at first, the process proceeds to step S103, in which the value of the counter CDTMSMP is decremented by "1" (step S103). When the value of the counter CDTMSMP becomes "1", the process proceeds from step S102 to S111 (FIG. 12).

In step S111, it is determined whether the tank pressure parameter PEONVAVE is less than a value obtained by subtracting the zone parameter PDTMZONE from the staying pressure parameter PDTMBASE. If the answer to step S111 is negative (NO), i.e., if the tank pressure parameter PEONVAVE is increasing or staying, it is further determined whether the tank pressure parameter PEONVAVE is greater than a value obtained by adding the zone parameter PDTMZONE to the staying pressure parameter PDTMBASE (step S112). When the answer to step S112 is negative (NO), the tank pressure parameter PEONVAVE is determined to be staying, and steps S113 to S115 are executed. Specifically, the downcount timer TEODTM is set to the predetermined waiting time period TMEODTM and started (step S113), and the quick down flag FQICKPDWN, an increase flag FPDTMUP, and a decrease flag FPDTMDN are all set to "0" (step S114). Further, in step S115, a counter CQIKPDN is set to "0". The increase flag FPDTMUP is set to "1" when the staying pressure parameter PDTMBASE is increased (refer to step S118), and the decrease flag FPDTMDN is set to "1" when the staying pressure parameter PDTMBASE is decreased (refer to step S127). Further, the counter CQIKPDN is a counter to be incremented while the tank pressure parameter PEONVAVE is determined to be decreasing (refer to step S128). After executing step S115, the process proceeds to step S131 (FIG. 13).

In step S112, if PEONVAVE is higher than (PDTMBASE+PDTMZONE), it is determined whether the value of the timer TEODTM is "0" (step S116). Since the answer to step S116 is negative (NO) at first, the process proceeds to step S121, in which both of the increase flag FPDTMUP and the decrease flag FPDTMDN are set to "0". Next, the value of the counter CQIKPDN is set to "0" (step S122), and the process proceeds to step S131.

If the value of the timer TOEDTM is "0" in step S116, the tank pressure parameter PEONVAVE is determined to be increasing, and the staying pressure parameter PDTMBASE is increased by the minimum sensible pressure PTANRESO (step S117). Next, the increase flag FPDTMUP is set to "1", and the decrease flag FPDTMDN is set to "0" (step S118). Further, the value of the counter CQIKPDN is set to "0" (step S119). Thereafter, the process proceeds to step S131.

If PEONVAVE is lower than (PDTMBASE−PDTMZONE) in step S111, the process proceeds to step S120, in which it is determined whether the value of the timer TEODTM is "0". Since the answer to step S120 is negative (NO) at first, the process proceeds to step S121 described above. When the answer to step S120 becomes affirmative (YES), the tank pressure parameter PEONVAVE is determined to be decreasing, the process proceeds to step S123, in which it is determined whether the staying pressure parameter PDTMBASE is equal to or less than the initial pressure PDTMINI. If the answer to step S123 is affirmative (YES), the process immediately proceeds to step S126. If PDTMBASE is higher than PDTMINI, it is determined whether the value of the counter CQIKPDN is equal to or greater than a quick down determination threshold value CTQIKPDN, e.g., "2" (step S124). Since the answer to step S124 is negative (NO) at first, the process proceeds to step S126.

In step S126, the staying pressure parameter PDTMBASE is decremented by the minimum sensible pressure PTANRESO. Next, the increase flag FPDTMUP is set to "0" and the decrease flag FPDTMDN is set to "1" (step S127). In step S128, the counter CQIKPDN is incremented by "1". Thereafter, the process proceeds to step S131.

If step S128 is repeatedly executed and the value of the counter CQIKPDN reaches the quick down determination threshold value CTQIKPDN, the process proceeds from step S124 to step S125, in which the quick down flag FQICKPDWN is set to "1".

In this embodiment, when the tank pressure parameter PEONVAVE continues to decrease for a period which is equal to or longer than a predetermined time period, i.e., a time period corresponding to the quick down determination threshold value CTQIKPDN, in the state where the staying pressure parameter PDTMBASE is higher than the initial pressure PDTMINI, it is determined that the filler cap 11 of the fuel tank has been removed, and the quick down flag FQICKPDWN is set to "1". The quick down flag FQICKPDWN is referred to in step S43 of FIG. 8 and step S152 of FIG. 14.

In step S131, a maximum value (hereinafter referred to as "maximum staying tank pressure") PDTMMAX of the staying pressure parameter PDTMBASE is calculated by the following expression (11). In step S132, a minimum value (hereinafter referred to as "minimum staying tank pressure") PDTMMIN of the staying pressure parameter PDTMBASE is calculated by the following expression (12).

$$PDTM\mathrm{MAX}=\mathrm{MAX}(PDTM\mathrm{MAX},\ PDTM\mathrm{BASE}) \tag{11}$$

$$PDTM\mathrm{MIN}=\mathrm{MIN}(PDTM\mathrm{MIN},\ PDTM\mathrm{BASE}) \tag{12}$$

In step S133, it is determined whether the maximum staying tank pressure PDTMMAX is greater than a value obtained by adding the minimum sensible pressure PTANRESO to the initial pressure PDTMINI. If the answer to step S133 is negative (NO), it is determined whether the minimum staying tank pressure PDTMMIN is less than a value obtained by subtracting the minimum sensible pressure PTANRESO from the initial pressure PDTMINI (step S134).

If both of the answers to steps S133 and S134 are negative (NO), the tank pressure PTANK is determined to be staying in the vicinity of the atmospheric pressure. Therefore, a downward change flag FPDWNCHG is set to "0" and the second leak determination condition flag FEODTMEX is set to "1" (step S135). The downward change flag FPDWNCHG is set to "1" when the tank pressure parameter PEONVAVE is decreasing (refer to step S141). After the second leak determination condition flag FEODTMEX is set to "1", an execution of the second leak determination is permitted. In step S143, the counter CDTMSMP is set to the predetermined value NO. Thereafter, the process ends. The answer to step S102 becomes negative (NO) by executing step S143. Accordingly, steps S111 to S143 are executed at a frequency of once in NO times execution of this process.

If the answer to step S133 is affirmative (YES), the tank pressure PTANK is determined to be increasing, and the process proceeds to step S136. Further, if the answer to step S133 is negative (NO) and the answer to step S134 is affirmative (YES), the tank pressure PTANK is determined to be decreasing, and the process proceeds to step S136.

In step S136, it is determined whether the decrease flag FPDTMDN is "1". If the answer to step S136 is negative (NO), it is determined whether the increase flag FPDTMUP is "1" (step S137). If the answer to step S137 is negative (NO), indicating that the tank pressure parameter PEONVAVE is neither increasing nor decreasing, the downward change flag FPDWNCHG is set to "0" (step S138), and the process proceeds to step S143 described above.

If FPDTMUP is equal to "1" in step S137, indicating that the tank pressure parameter PEONVAVE is increasing, both of the downward change flag FPDWNCHG and the second leak determination condition flag FEODTMEX are set to "0" (step S139), and the process proceeds to step S143 described above.

If FPDTMDN is equal to "1" in step S136, indicating that the tank pressure parameter PEONVAVE is decreasing, it is determined whether the second leak determination condition flag FEODTMEX is "1" (step S140). If the answer to step S140 is negative (NO), the second leak determination condition flag FEODTMEX is set to "1" (step S142), and the process proceeds to step S143 described above.

On the other hand, if FEODTMEX is "1" in step S140, the downward change flag FPDWNCHG is set to "1" (step S141), and the process proceeds to step S142 described above.

Figure 14:
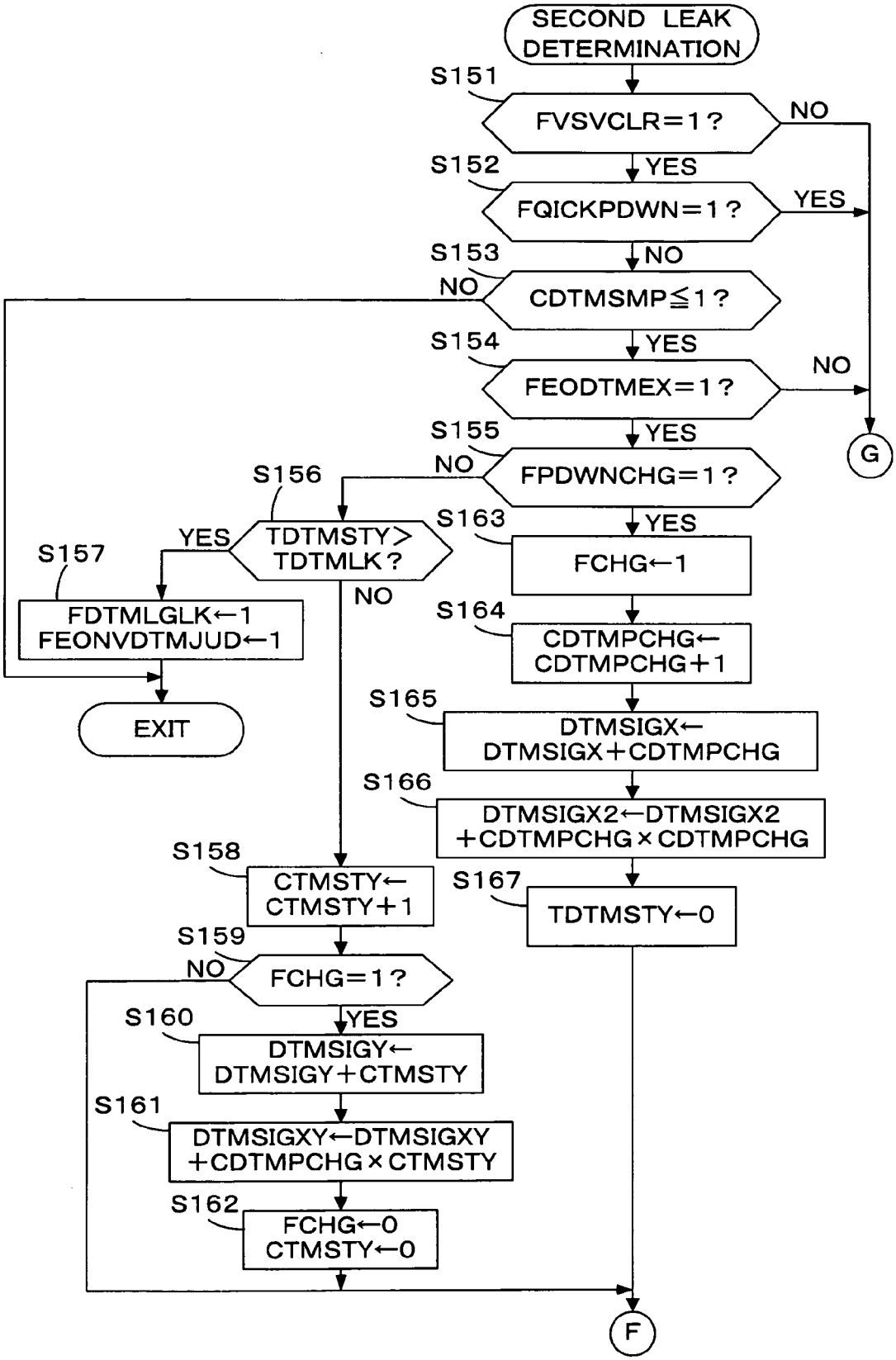
FIGS. 14 and 15 are flowcharts of a process for performing the second leak determination.
Figure 15:
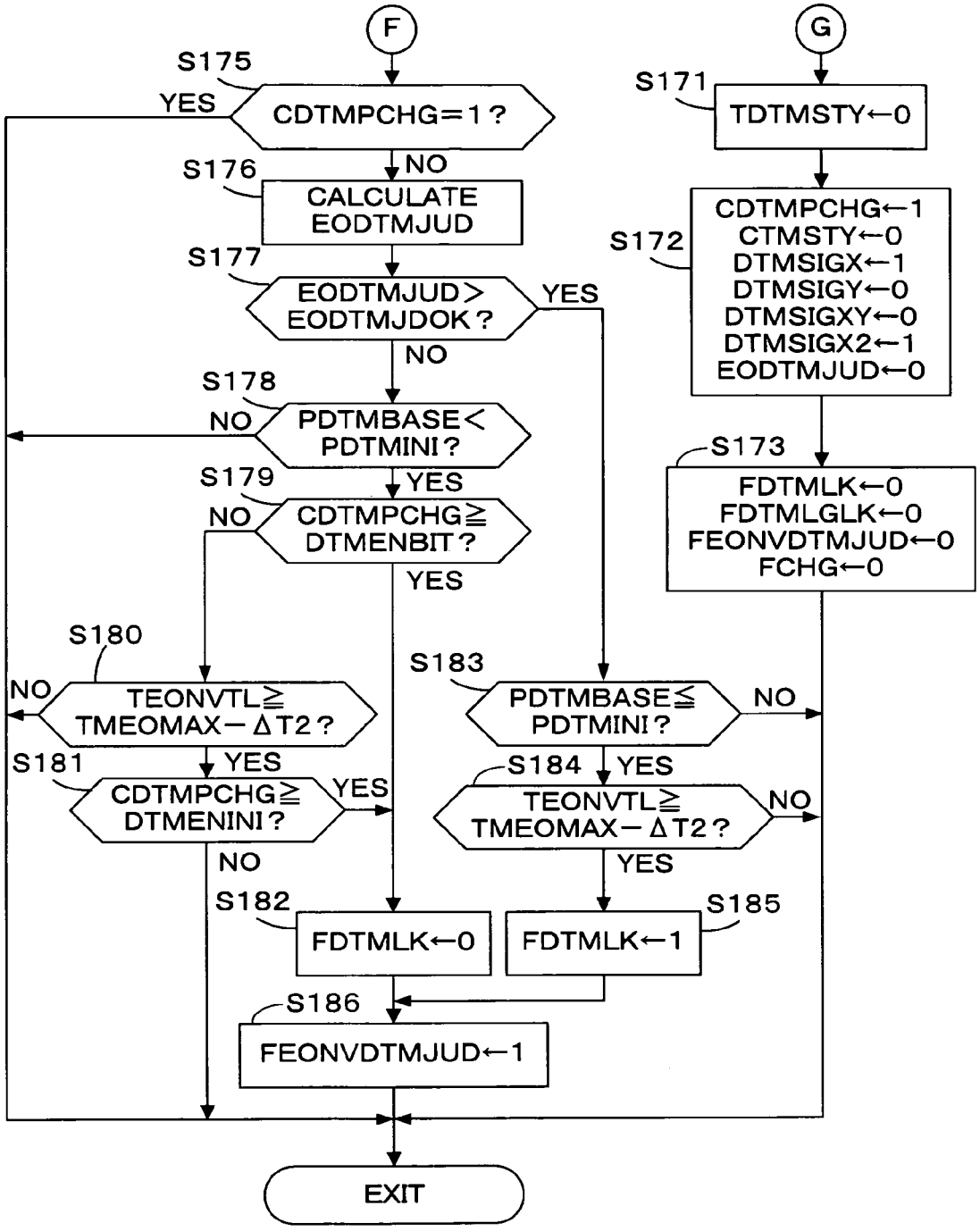
Figure 16:
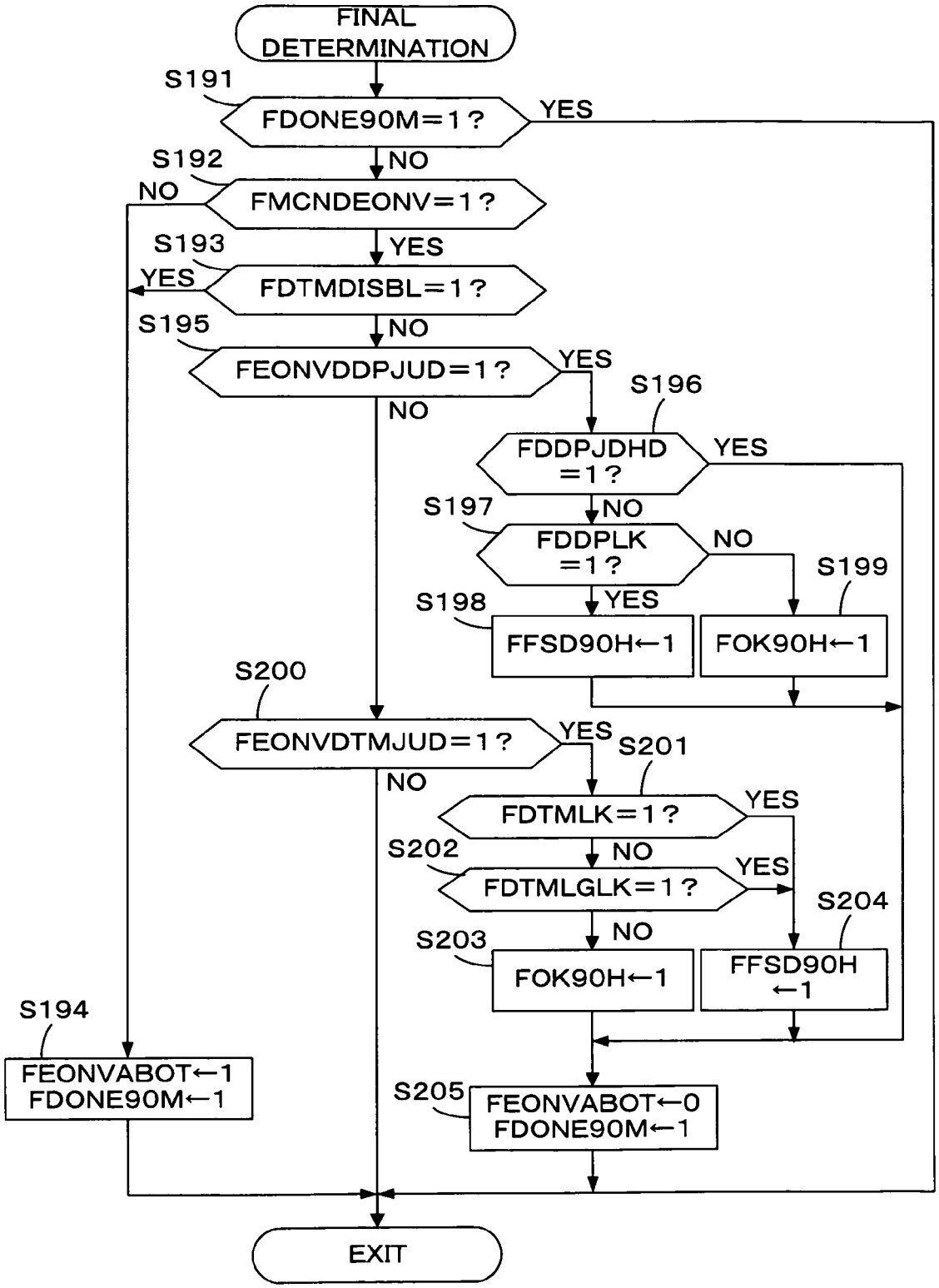
FIG. 16 is a flowchart of a final determination process based on results of the first leak determination and the second leak determination.

FIGS. 14 and 15 are flowcharts of the second leak determination process executed in step S8 of FIG. 6.

In step S151, it is determined whether the VSV closing request flag FVSVCLR is "1". IF FVSVCLR is equal to "0", indicating that the vent shut valve 38 is open, steps S171 to S173 are executed to perform an initialization of the parameters used in the process. In step S171, the value of an upcount timer TDTMSTY is set to "0". In step S172, the parameters for calculating the second inclination parameter EODTMJUD corresponding to inclinations of the regression lines L11 and L12 shown in FIG. 5, are initialized. Specifically, a pressure parameter CDTMPCHG corresponding to the tank pressure PTANK shown in FIG. 5 is set to "1", a staying time period parameter CTMSTY corresponding to the staying time period TSTY shown in FIG. 5 is set to "0", an integrated value DTMSIGX of the pressure parameter CDTMPCHG is set to "1", an integrated value DTMSIGY of the staying time period parameter CTMSTY is set to "0", an integrated value DTMSIGXY of the product of the pressure parameter CDTMPCHG and the staying time period parameter CTMSTY is set to "0", an integrated value DTMSIGX2 of the value obtained by squaring the pressure parameter CDTMPCHG is set to "1", and the second inclination parameter EODTMJUD is set to "0".

In step S173, a second leak determination flag FDTMLK, a large hole determination flag FDTMLGLK, a second leak determination end flag FEONVDTMJUD, and a pressure change flag FCHG are all set to "0". The second leak determination flag FDTMLK is set to "1", when it is determined that there is a small hole leak in the system (refer to step S185). It is determined that there is a leak through a large hole (hereinafter referred to as "large hole leak") in the system and the large hole determination flag FDTMLGLK is set to "1", when the tank pressure PTANK stays in the vicinity of the atmospheric pressure for a time period which is longer than a predetermined determination time period TDTMLK, e.g., 600 seconds (refer to step S157). The second leak determination end flag FEONVDTMJUD is set to "1", when the determination is made that the system is normal, or the determination is made that a leak is present in the system (refer to steps S157 and S186). The pressure change flag FCHG is set to "1", when the downward change flag FPDWNCHG is set to "1" (refer to step S163). When the downward change flag FPDWNCHG is "0", and the integrated value DTMSIGY of the stayng time period parameter CTMSTY and the integrated value DTMSIGXY of the product of the pressure parameter CDTMPCHG and the staying time period parameter CTMSTY are calculated, the pressure change flag FCHG is returned to "0" (refer to step S162).

If FVSVCLR is equal to "1" in step S151, indicating that the vent shut valve 38 is closed, it is determined whether the quick down flag FQICKPDWN is "1" (step S152). If the answer to step S152 is affirmative (YES), the process proceeds to step S171 described above. If the answer to step S152 is negative (NO), it is determined whether the value of the counter CDTMSMP is equal to or less than "1" (step S153). If the answer to step S153 is negative (NO), the process immediately ends.

If the value of the counter CDTMSMP is equal to or less than "1" in step S153, the process proceeds to step S154, in which it is determined whether the second leak determination condition flag FEODTMEX is "1". If the answer to step S154 is negative (NO), the process proceeds to step S171 described above. If FEODTMEX is equal to "1" in step S154, indicating that the execution condition of the second leak determination is satisfied, it is determined whether the downward change flag FPDWNCHG is "1" (step S155). When the second leak determination condition flag FEODTMEX is "1" and the downward change flag FPDWNCHG is "0", indicating that the tank pressure parameter PEONVAVE is staying at a substantially constant level, it is determined whether the value of the upcount timer TDTMSTY set to "0" in step S171 or S167 is greater than the predetermined determination time period TDTMLK (step S156). Since the answer to step S156 is negative (NO) at first, the process proceeds to step S158, in which the staying time period parameter CTMSTY is incremented by "1". Next, it is determined whether the pressure change flag FCHG is "1" (step S159). Since the answer to step S159 is negative (NO) at first, the process immediately proceeds to step S175 (FIG. 15).

On the other hand, if the value of the timer TDTMSTY is greater than the predetermined determination time period TDTMLK in step S156, it is determined that there is a large hole leak in the system, the large hole determination flag FDTMLGLK and the second leak determination end flag FEONVDTMJUD are set to "1" (step S157).

If FPDWNCHG is equal to "1" in step S155, indicating that the staying pressure parameter PDTMBASE is decreasing, the process proceeds to step S163, in which the pressure change flag FCHG is set to "1". In step S164, the pressure parameter CDTMPCHG is incremented by "1". Although the pressure parameter CDTMPCHG is a parameter corresponding to the tank pressure PTANK indicated on the horizontal axis of FIG. 5C or 5D, the pressure parameter CDTMPCHG increases as the tank pressure PTANK decreases. Therefore, the second inclination parameter EODTMJUD calculated in the process takes a negative value corresponding to the straight line L11 (normal state) shown in FIG. 5C, and a positive value corresponding to the straight line L12 (small hole leak) shown in this FIG. 5D.

In step S165, the integrated value DTMSIGX of the pressure parameter CDTMPCHG is calculated by the following expression (13).

$$DTMSIGX=DTMSIGX+CDTMPCHG \tag{13}$$

where DTMSIGX on the right side is the preceding calculated value.

In step S166, the integrated value DTMSIGX2 of a value obtained by squaring the pressure parameter CDTMPCHG is calculated by the following expression (14).

$$DTMSIGX2=DTMSIGX2+CDTMPCHG\times CDTMPCHG \tag{14}$$

where DTMSIGX2 on the right side is the preceding calculated value.

In step S167, the value of he timer TDTMSTY is returned to "0". Thereafter, the process proceeds to step S175.

If the answer to step S155 becomes negative (NO) after the pressure change flag FCHG is set to "1", the process proceeds to step S159. Since the answer to step S159 is affirmative (YES), the process proceeds to step S160, in which the integrated value DTMSIGY of the staying time period parameter CTMSTY is calculated by the following expression (15).

$$DTMSIGY=DTMSIGY+CTMSTY \tag{15}$$

where DTMSIGY on the right side is the preceding calculated value.

In step S161, the integrated value DTMSIGXY of the product of the pressure parameter CDTMPCHG and the staying time period parameter CTMSTY is calculated by the following expression (16).

$$DTMSIGXY=DTMSIGXY+CDTMPCHG\times CTMSTY \tag{16}$$

where DTMSIGXY on the right side is the preceding calculated value.

In step S162, the pressure change flag FCHG is returned to "0", and the staying time period parameter CTMSTY is returned to "0". Thereafter, the process proceeds to step S175.

In step S175, it is determined whether the pressure parameter CDTMPCHG is "1". If the answer to step S175 is affirmative (YES), the inclination of the regression line cannot be calculated. Accordingly, the process immediately ends. If CDTMPCHG is greater than "1", the pressure parameter CDTMPCHG, and the integrated values DTMSIGX, DTMSIGX2, DTMSIGY, and DTMSIGXY are applied to the following expression (17) to calculate the second inclination parameter EODTMJUD (step S176). In this embodiment, every time the staying pressure parameter PDTMBASE decreases, the pressure parameter CDTMPCHG is incremented by "1". Therefore, the pressure parameter CDTMPCHG is also a parameter indicative of the number of sampling data. Accordingly, the pressure parameter CDTMPCHG is applied to the expression (17).

$$EODTMJUD=\frac{DTMSIGXY-(DTMSIGX\times DTMSIGY)/CDTMPCHG}{DTMSIGX2-DTMSIGX^2/CDTMPCHG} \tag{17}$$

In step S177, it is determined whether the second inclination parameter EODTMJUD is greater than the determination threshold value EODTMJDOK. If the answer to step S177 is affirmative (YES), it is further determined whether the staying pressure parameter PDTMBASE is equal to or less than the initial pressure PDTMINI (step S183). If the answer to step S183 is affirmative (YES), it is further determined whether the value of the timer TEONVTL is equal to or greater than a value obtained by subtracting a predetermined time period ΔT2, e.g., 5 seconds, from the maximum diagnosing time period TMEOMAX (step S184). If the answer to step S183 or S184 is negative (NO), the process immediately ends. When both of the answers to steps S183 and S184 becomes affirmative (YES), it is determined that a small hole leak is present in the system. Accordingly, the second leak determination flag FDTMLK is set to "1" (step S185) and the second leak determination end flag FEONVDTMJUD is set to "1" (step S186).

If EODTMJUD is less than or equal to EODTMJDOK in step S177, it is determined whether the staying pressure parameter PDTMBASE is less than the initial pressure PDTMINI (step S178). If the answer to step S178 is negative (NO), the process immediately ends. If PDTMBASE is less than PDTMINI, it is determined whether the value of the pressure parameter CDTMPCHG, which corresponds to the number of data used for the determination, is greater than a first predetermined data number DTMENBIT, e.g.,"30" (step S179). If the answer to step S179 is affirmative (YES), the evaporative fuel processing system 40 is determined to be normal, and the second leak determination flag FDTMLK is set to "0" (step S182). Thereafter, the process proceeds to step S186 described above.

If CDTMPCHG is less than DTMENBIT in step S179, it is determined whether the value of the timer TEONVTL is equal to or greater than a value obtained by subtracting the predetermined time period ΔT2 from the maximum diagnosing time period TMEOMAX (step S180). If the answer to step S180 is a negative (NO), the process immediately ends. When the answer to step S180 becomes affirmative (YES), it is determined whether the value of the pressure parameter CDTMPCHG is equal to or greater than a second predetermined data number DTMENINI, e.g., "5", which is less than the first predetermined data number DTMENBIT (step S181). If the answer to step S181 is negative (NO), the process immediately ends. If the answer to step S181 is affirmative (YES), the evaporative fuel processing system 40 is determined to be normal, and the process proceeds to step S182 described above.

FIG. 16 is a flowchart of the final determination process executed in step S9 of FIG. 6.

In step S191, it is determined whether the determination completion flag FDONE is "1". If the answer to step S191 is affirmative (YES), the process immediately ends. If FDONE90M is equal to "0", it is determined whether the execution condition flag FMCNDEONV is "1" (step S192). If the answer to step S192 is affirmative (YES), it is determined whether the determination disabling flag FDTMDISBL is "1" (step S193). If FMCNDEONV is equal to "0" or FDTMDISBL is equal to "1", an interruption flag FEONVABOT and the determination completion flag FDONE90M are set to "1" (step S194), and the process ends.

If FDTMDISBL is equal to "0" in step S193, it is determined whether the first leak determination end flag FEONVDDPJUD is "1." If FEONVDDPJUD is equal to "1", indicating that the first leak determination is completed, it is determined whether the withholding flag FDDPJDHD is "1" (step S196). If the withholding flag FDDPJDHD is "1", the interruption flag FEONVABOT is set to "0" and the determination completion flag FDONE90M is set to "1" (step S205).

If the withholding flag FDDPJDHD is "0" in step S196, the process proceeds to step S197, in which it is determined whether the first leak determination flag FDDPLK is "1". If FDDPLK is equal to "1", a failure flag FFSD9OH is set to "1" (step S198). If FDDPLK is equal to "0", a normality flag FOK9OH is set to "1" (step S199). Thereafter, the process proceeds to step S205 described above.

If the first leak determination is not completed, the process proceeds from step S195 to step S200, in which it is determined whether the second leak determination end flag FEONVDTMJUD is "1". If the answer to step S200 is negative (NO), the process immediately ends. If the second leak determination is completed, the process proceeds from step S200 to step S201, in which it is determined whether the second leak determination flag FDTMLK is "1". If FDTMLK is equal to "1", the failure flag FFSD90H is set to "1" (step S204). If FDTMLK is equal to "0", it is determined whether the large hole determination flag FDTMLGLK is "1" (step S202). If FDTMLGLK is equal to "1", the process proceeds to step S204 described above. If FDTMLGLK is equal to "0", the normality flag FOK90H is set to "1" (step S203). Thereafter, the process proceeds to step S205 described above.

Figures 17A, 17B, 17C, 17D:
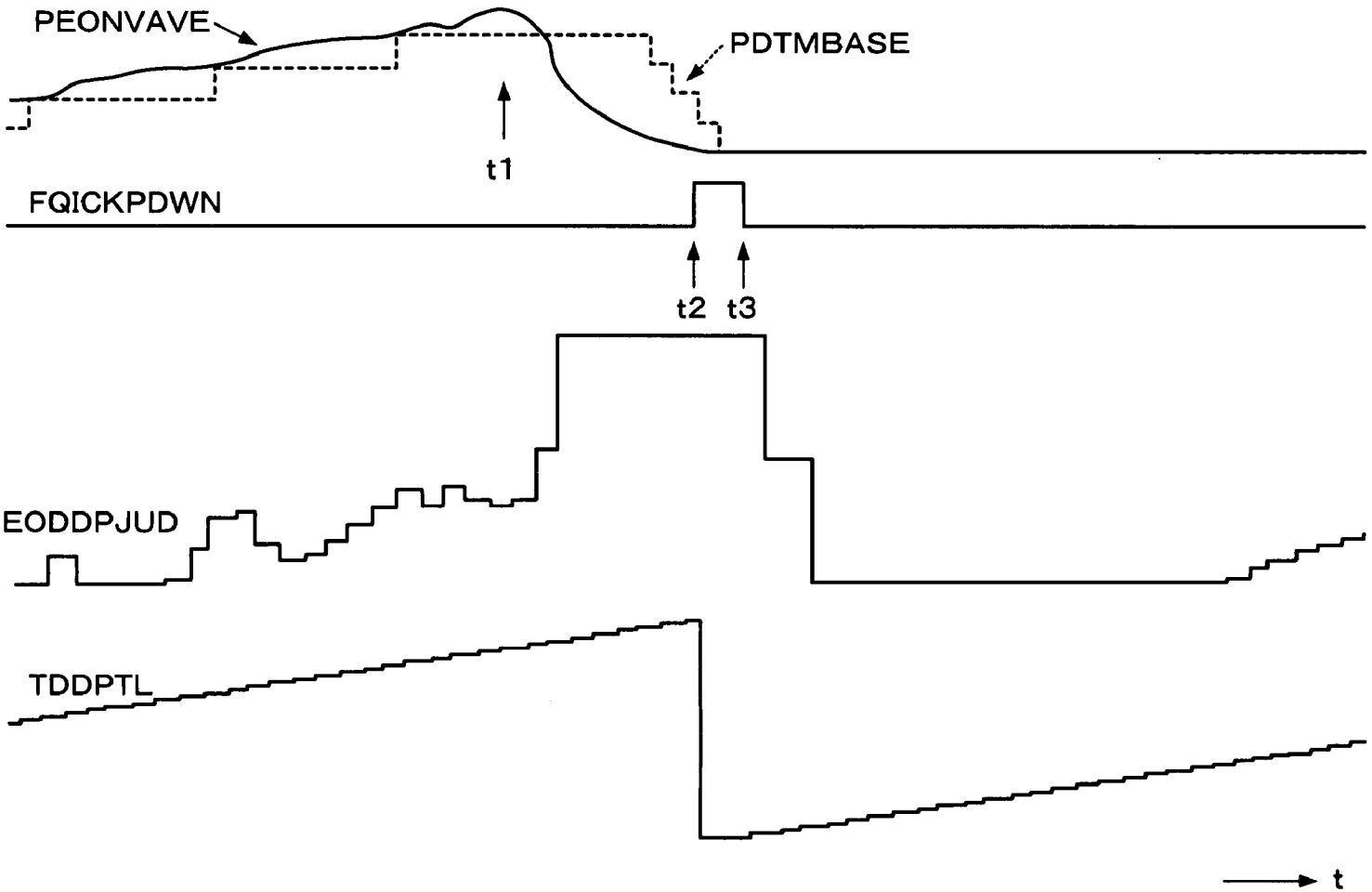
FIGS. 17A–17D are time charts illustrating the process for a case where the filler cap is removed.

FIGS. 17A–17D are time charts for illustrating a process for the case where the filler cap 11 of the fuel tank is removed. In FIG. 17A, an example in which the filler cap 11 is removed at time t1 is shown. Since the tank pressure PTANK will decrease rapidly if the filler cap 11 is removed, the pressure parameter PEONVAVE decreases rapidly, which causes a decrease of the staying pressure parameter PDTMBASE. Consequently, removal of the filler cap 11 is detected at time t2, and the quick down flag FQICKPDWN is set to "1" (refer to FIG. 12, step S125). When the quick down flag FQICKPDWN is set to "1", initialization of the parameters used for the determination is performed in both of the first leak determination process and the second leak determination process (refer to FIG. 8, steps S44–S47 and FIG. 15, steps S171–S173). Accordingly, as shown in FIGS. 17C and 17D for example, the determination parameter EODDPJUD is set to "0" and the value of the timer TDDPTL is also set to "0".

Since the quick down flag FQICKPDWN is reset shortly after the pressure parameter PEONVAVE stays in the vicinity of the atmospheric pressure (FIG. 17B, time t3), the leak determination is immediately restarted.

As described above, in this embodiment, if the filler cap 11 is removed for refueling during execution of the leak determination, a rapid decrease of the tank pressure PTANK due to removal of the filler cap 11 is detected, and the various parameters used in the determination are initialized. Therefore, an erroneous determination is prevented. Further, after initialization of the parameters used in the determination, the leak determination is immediately restarted if the pressure parameter PEONVAVE remains in the vicinity of the atmospheric pressure. Accordingly, execution frequency of the leak determination is prevented from decreasing, compared with an example where the determination is inhibited when a rapid decrease of the detected pressure is detected.

Figure 18:
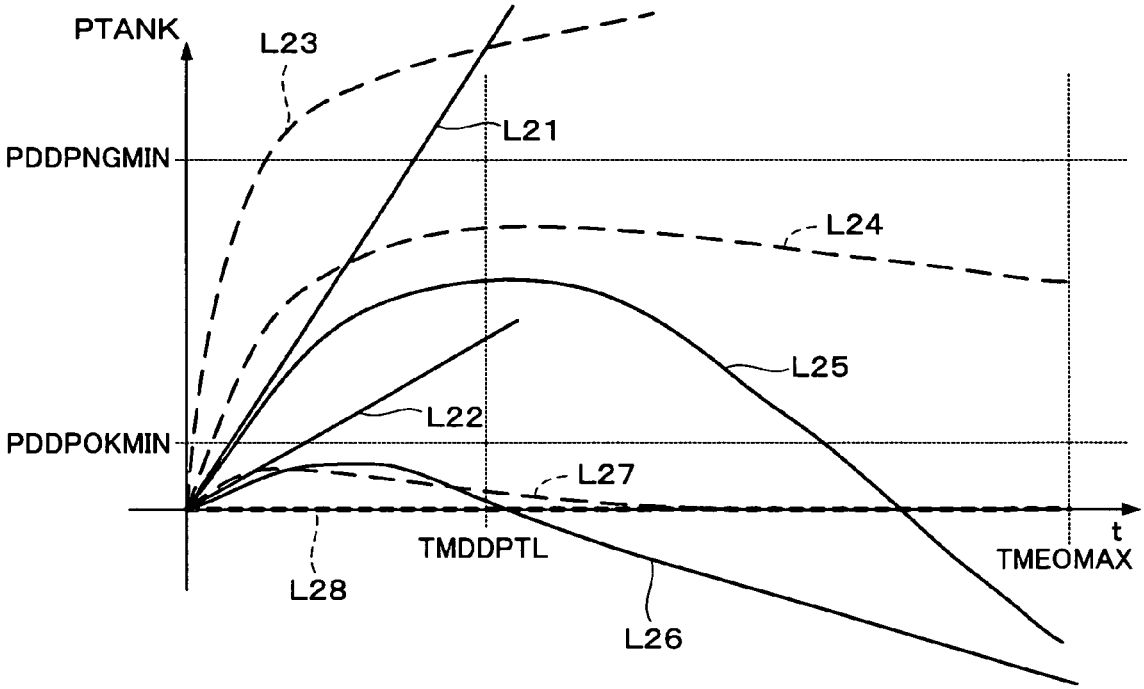
FIG. 18 is a time chart for illustrating the first leak determination and the second leak determination.

FIG. 18 is a time chart illustrating the leak determination process described above, and shows changes in the tank pressure PTANK after closing of the vent shut valve. Different cases corresponding to values of the maximum pressure DPEOMAX will be explained below:

1) the case where the maximum pressure DPEOMAX becomes equal to or higher than the second threshold value PDDPNGMIN If the tank pressure PTANK, i.e., the maximum pressure DPEOMAX, as shown by a solid line L21, exceeds the second threshold value PDDPNGMIN, i.e., an amount of generated evaporative fuel is comparatively large, and increases linearly, the determination parameter EODDPJUD takes a value near "0". Accordingly, the system is determined to be normal in the first leak determination process (FIG. 10, steps S72, S73, and S74).

If the tank pressure PTANK, as shown by a dashed line L23, exceeds the second threshold value PDDPNGMIN, and an inclination of the line L23 decreases gradually, the determination parameter EODDPJUD takes a comparatively large value. Accordingly, it is determined in the first determination process that a leak is present in the system (FIG. 10, steps S75, S77, and S78).

2) the case where the maximum pressure DPEOMAX is equal to or higher than the first threshold value PDDPOKMIN, and lower than the second threshold value PDDPNGMIN If the tank pressure PTANK, as shown by a solid line L22, exceeds the first threshold value PDDPOKMIN, i.e., an amount of generated evaporative fuel is comparatively large, and increases linearly, the determination parameter EODDPJUD takes a value near "0". Accordingly, the system is determined to be normal in the first leak determination process (refer to FIG. 10, steps S72, S73, and S74).

Further, if the tank pressure PTANK, as shown by a dashed line L24 or a solid line L25, exceeds the first threshold value PDDPOKMIN and does not reach the second threshold value PDDPNGMIN, the determination result cannot be obtained within the predetermined time period TMDDPTL. Therefore, subsequent changes in the tank pressure PTANK are monitored. Further, in the example shown by the dashed line L24, it is determined in the first leak determination process that there is a leak in the system, since the tank pressure PTANK does not decrease until a time immediately before the determination execution time period reaches the maximum diagnosing time period TMEOMAX (refer to FIG. 10, steps S77, S79, and S81). On the other hand, in the example shown by the solid line L25, the answer to step S80 of FIG. 10 becomes affirmative (YES), since the tank pressure PTANK becomes lower than the initial pressure PDTMINI before the determination execution time period reaches the maximum diagnosing time period TMEOMAX. That is, a determination result as to whether a leak is present is not obtained in the first leak determination process, and it is determined in the second leak determination process that the system is normal, since the second inclination parameter EODTMJUD becomes equal to or less than the determination threshold value EODTMJDOK (steps S177–S182).

3) the case where the maximum pressure DPEOMAX does not reach the first threshold value PDDPOKMIN.

If the tank pressure PTANK, as shown by a solid line L26 and dashed lines L27 and L28, does not reach the first threshold value PDDPOKMIN, i.e., when the amount of generated evaporative fuel is comparatively small, the answer to step S72 of FIG. 10 does not become affirmative (YES). Accordingly, a determination result as to whether a leak is present is not obtained in the first leak determination process. In the second leak determination process, the system is determined to be normal in the example shown by the solid line L26 (FIG. 15, steps S177–S182), and it is determined that a leak is present in the example shown by the dashed line L27 (FIG. 15, steps S177, and S183–S185).

Further, if the tank pressure PTANK, as shown by the dashed line L28, remains in the vicinity of the atmospheric pressure and does not fluctuate at all, it is determined that a large hole leak is present (FIG. 14, steps S155–S157).

In this embodiment, as described above, the maximum pressure DPEOMAX is adopted as the evaporative fuel parameter indicative of an amount of evaporative fuel generated in the fuel tank 9, and one of the determination results of the first leak determination process or the second leak determination process is selected according to the maximum pressure DPEOMAX. Accordingly, accurate determination is performed irrespective of the amount of evaporative fuel generated in the fuel tank.

Further, if the maximum pressure DPEOMAX reaches the first threshold value PDDPOKMIN (the answer to step S72 becomes affirmative (YES) in FIG. 10), i.e., the amount of generated evaporative fuel is comparatively large, and the leak determination is completed in the first leak determination process, that is, any one of the determination that the system is normal, the determination that a leak is present, or the decision that the determination is withheld, is made in the first leak determination process (steps S74,S78,S81,and S76), the determination result of the first leak determination process is adopted as the final determination (FIG. 10, step S82, and FIG. 16, step S195–S199). Accordingly, a determination result can be rapidly obtained.

Further, when the first leak determination process is not completed, i.e., the answer to step S80 is affirmative (YES), even if the maximum pressure DPEOMAX reaches the first threshold value PDDPOKMIN, indicating that the amount of generated evaporative fuel is comparatively large, or when the maximum pressure DPEOMAX does not reach the first threshold value PDDPOKMIN, indicating that the amount of generated evaporative fuel is comparatively small, the determination result of the second leak determination process is selected. Accordingly, whether the leak is present can be accurately determined after stoppage of the engine, when the determination result is not obtained in the first determination process even if the amount of generated evaporative fuel is large, or when the amount of generated evaporative fuel is small.

More specifically, when the maximum pressure DPEOMAX is equal to or higher than the first threshold value PDDPOKMIN, and lower than the second threshold value PDDPNGMIN, there are two cases. One is a case where the determination that a leak is present is made in the first leak determination process, and the other is a case where the system is determined to be normal in the second leak determination process. That is, when the staying pressure parameter PDTMBASE fails to decrease to a value equal to or lower than the initial pressure PDTMINI in the continued monitoring of the tank pressure PTANK during the determination period, the determination result obtained by means of the determination parameter EODDPJUD, i.e., the determination result that a leak is present, is adopted as the final determination (FIG. 10, steps S80 and S81). On the other hand, when the staying pressure parameter PDTMBASE decreases to a value equal to or lower than the initial pressure PDTMINI during the determination period, the determination cannot be completed in the first leak determination process. Therefore, the determination result by the second leak determination process is adopted as the final determination, i.e., the answer to step S80 of FIG. 10 becomes affirmative (YES). The determination accuracy in the case where the amount of generated evaporative fuel is comparatively large but not very large, is improved.

In this embodiment, the pressure sensor 15 corresponds to the pressure detecting means, and the ignition switch 42 corresponds to the engine stoppage detecting means. Further, the ECU5 constitutes the first determining means, the second determining means, the evaporative fuel parameter calculating means, and the final determining means. Specifically, the process shown in FIGS. 8 and 9, steps S71, S73–S76, S78, and S82 of FIG. 10, correspond to the first determining means. The process shown in FIGS. 14 and 15 corresponds to the second determining means. Steps S72, S77, and S79–S81 of FIG. 10, and the process shown in FIG. 16 correspond to the final determining means.

It is to be noted that the present invention is not limited to the embodiments described above, but various modifications may be made thereto without departing from the spirit and/or scope thereof. In the embodiments described above, the pressure sensor 15 is disposed in the charge passage 31. The location of the pressure sensor 15 is not limited to such a position. Alternatively, the pressure sensor 15 may be disposed, for example, in the fuel tank 9 or the canister 33.

Further, in the embodiment described above, the tank pressure parameter PEONVAVE and the staying tank pressure parameter PDTMBASE, obtained by averaging the tank pressure PTANK, are used to perform the leak determination. Alternatively, the tank pressure PTANK itself may be used for the leak determination.

Further, in the process of FIGS. 14 and 15, the least squares method is applied to the pressure parameter CDTMPCHG and the staying time period parameter CTMSTY to calculate the second inclination parameter EODTMJUD. Alternatively, the least squares method may be applied to the tank pressure PTANK and the value of the upcount timer TDTMSTY to calculate the second inclination parameter EODTMJUD.

Furthermore, the present invention can be applied also to a failure diagnosis for an evaporative fuel processing system, including a fuel tank for supplying fuel to a watercraft propulsion engine such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A failure diagnosis apparatus for diagnosing a failure of an evaporative fuel processing system that includes a fuel tank, a canister having adsorbent for adsorbing evaporative fuel generated in said fuel tank, an air passage connected to said canister for communicating said canister communicates with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis apparatus comprising:

pressure detecting means for detecting a pressure in said evaporative fuel processing system;

engine stoppage detecting means for detecting stoppage of said engine;

first determining means for closing said purge control valve and said vent shut valve when stoppage of said engine is detected by said engine stoppage detecting means, and for determining whether there is a leak in said evaporative fuel processing system based on a determination parameter corresponding to a second-order derivative value of the pressure detected by said pressure detecting means during a first predetermined determination period after closing of said purge control valve and said vent shut valve;

second determining means for determining whether the leak is present in said evaporative fuel processing system based on a relationship between the pressure detected by said pressure detecting means and a staying time period in which the detected pressure stays at a substantially constant value, during a second predetermined determination period which is longer than the first predetermined determination period after closing of said purge control valve and said vent shut valve;

evaporative fuel parameter calculating means for calculating an evaporative fuel parameter indicative of an amount of evaporative fuel generated in said fuel tank after stoppage of said engine; and final determining means for selecting one of the determination results of said first determining means and said second determining means, according to the evaporative fuel parameter calculated by said evaporative fuel parameter calculating means.

2. The failure diagnosis apparatus according to claim 1, wherein said final determining means selects the determination result of said first determining means when the evaporative fuel parameter is greater than or equal to a first threshold value and the determination by said first determining means is completed.

3. The failure diagnosis apparatus according to claim 1, wherein said final determining means selects the determination result of said second determining means when the evaporative fuel parameter is greater than or equal to a first threshold value and the determination by said first determining means is not completed, or when the evaporative fuel parameter is less than the first threshold value.

4. The failure diagnosis apparatus according to claim 2, wherein said final determining means selects the determination result of said first determining means when the evaporative fuel parameter is greater than or equal to the first threshold value and less than a second threshold value which is greater than the first threshold value, and wherein the detected pressure does not become less than or equal to a predetermined determination pressure during the second predetermined determination period.

5. The failure diagnosis apparatus according to claim 2, wherein said final determining means selects the determination result of said second determining means when the evaporative fuel parameter is greater than or equal to the first threshold value and less than a second threshold value which is greater than the first threshold value, and wherein the detected pressure becomes less than or equal to a predetermined determination pressure during the second predetermined determination period.

6. A failure diagnosis method for diagnosing a failure of an evaporative fuel processing system that includes a fuel tank, a canister having adsorbent for adsorbing evaporative fuel generated in said fuel tank, an air passage connected to said canister for communicating said canister with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis method comprising the steps of:

a) detecting stoppage of said engine;

b) detecting a pressure in said evaporative fuel processing system;

c) closing said purge control valve and said vent shut valve when stoppage of said engine is detected, d) determining whether there is a leak in said evaporative fuel processing system based on a determination parameter corresponding to a second-order derivative value of the detected pressure during a first predetermined determination period after closing of said purge control valve and said vent shut valve;

e) determining whether the leak is present in said evaporative fuel processing system based on a relationship between the detected pressure and a staying time period in which the detected pressure stays at a substantially constant value, during a second predetermined determination period which is longer than the first predetermined determination period after closing of said purge control valve and said vent shut valve;

f) calculating an evaporative fuel parameter indicative of an amount of evaporative fuel generated in said fuel tank after stoppage of said engine; and g) selecting one of the determination results of said step d) and said step e) according to the calculated evaporative fuel parameter.

7. The failure diagnosis method according to claim 6, wherein the determination result of said step d) is selected when the evaporative fuel parameter is greater than or equal to a first threshold value and the determination of said step d) is completed.

8. The failure diagnosis method according to claim 6, wherein the determination result of said step e) is selected when the evaporative fuel parameter is greater than or equal to a first threshold value and the determination of said step d) is not completed, or when the evaporative fuel parameter is less than the first threshold value.

9. The failure diagnosis method according to claim 7, wherein the determination result of said step d) is selected when the evaporative fuel parameter is greater than or equal to the first threshold value and less than a second threshold value which is greater than the first threshold value, and wherein the detected pressure does not become less than or equal to a predetermined determination pressure during the second predetermined determination period.

10. The failure diagnosis apparatus according to claim 7, wherein the determination result of said step e) is selected when the evaporative fuel parameter is greater than or equal to the first threshold value and less than a second threshold value which is greater than the first threshold value, and wherein the detected pressure becomes less than or equal to a predetermined determination pressure during the second predetermined determination period.

11. A computer program embodied on a computer-readable medium, for causing a computer to carry out a failure diagnosis method for diagnosing a failure of an evaporative fuel processing system that includes a fuel tank, a canister having adsorbent for adsorbing evaporative fuel generated in said fuel tank, an air passage connected to said canister for communicating said canister with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis method comprising the steps of:

a) detecting stoppage of said engine;

b) detecting a pressure in said evaporative fuel processing system;

c) closing said purge control valve and said vent shut valve when stoppage of said engine is detected, d) determining whether there is a leak in said evaporative fuel processing system based on a determination parameter corresponding to a second-order derivative value of the detected pressure during a first predetermined determination period after closing of said purge control valve and said vent shut valve;

e) determining whether the leak is present in said evaporative fuel processing system based on a relationship between the detected pressure and a staying time period in which the detected pressure stays at a substantially constant value, during a second predetermined determination period which is longer than the first predetermined determination period after closing of said purge control valve and said vent shut valve;

f) calculating an evaporative fuel parameter indicative of an amount of evaporative fuel generated in said fuel tank after stoppage of said engine; and g) selecting one of the determination results of said step d) and said step e) according to the calculated evaporative fuel parameter.

12. The computer program according to claim 11, wherein the determination result of said step d) is selected when the evaporative fuel parameter is greater than or equal to a first threshold value and the determination of said step d) is completed.

13. The computer program according to claim 11, wherein the determination result of said step e) is selected when the evaporative fuel parameter is greater than or equal to a first threshold value and the determination of said step d) is not completed, or when the evaporative fuel parameter is less than the first threshold value.

14. The computer program according to claim 12, wherein the determination result of said step d) is selected when the evaporative fuel parameter is greater than or equal to the first threshold value and less than a second threshold value which is greater than the first threshold value, and wherein the detected pressure does not become less than or equal to a predetermined determination pressure during the second predetermined determination period.

15. The computer program according to claim 12, wherein the determination result of said step e) is selected when the evaporative fuel parameter is greater than or equal to the first threshold value and less than a second threshold value which is greater than the first threshold value, and wherein the detected pressure becomes less than or equal to a predetermined determination pressure during the second predetermined determination period.

* * * * *